US009441364B2

(12) United States Patent
Bertoldini et al.

(10) Patent No.: US 9,441,364 B2
(45) Date of Patent: Sep. 13, 2016

(54) SUPPORT FRAMEWORK FOR BUILDING CASING, BUILDING CASING, BUILDING STRUCTURE AND METHOD FOR MANUFACTURING THEREOF

(71) Applicant: TOP GLASS EU SA, Lugano (CH)

(72) Inventors: Augusto Bertoldini, Premana (IT); Alfonso Branca, Milan (IT)

(73) Assignees: TOP GLASS EU SA, Lugano (CH); Augusto Bertoldini, Lecco (IT)

( * ) Notice: Subject to any disclaimer, the term of this patent is extended or adjusted under 35 U.S.C. 154(b) by 0 days.

(21) Appl. No.: 14/440,247

(22) PCT Filed: Nov. 5, 2013

(86) PCT No.: PCT/IB2013/059918

§ 371 (c)(1),
(2) Date: May 1, 2015

(87) PCT Pub. No.: WO2014/068547

PCT Pub. Date: May 8, 2014

(65) Prior Publication Data

US 2015/0275512 A1 Oct. 1, 2015

(30) Foreign Application Priority Data

Nov. 5, 2012 (IT) ..... BS2012A0157

(51) Int. Cl.

| | |
|---|---|
| ***E04H 1/00*** | (2006.01) |
| ***E04B 2/58*** | (2006.01) |
| ***E04B 2/88*** | (2006.01) |

(Continued)

(52) U.S. Cl.

CPC . *E04B 2/58* (2013.01); *E04B 1/24* (2013.01); *E04B 1/40* (2013.01); *E04B 2/88* (2013.01); *E04D 13/17* (2013.01); *F24F 7/02* (2013.01); *E04B 1/003* (2013.01); *E04B 2001/2415* (2013.01); *E04B 2001/2445* (2013.01); *E04B 2001/2448* (2013.01);

(Continued)

(58) Field of Classification Search

CPC .... E04B 2/58; E04B 1/28; E04B 2001/2445; E04B 2001/2448; E04B 2001/2415; E04C 2003/0439; E04C 2003/0473

USPC ..... 52/236.3, 236.9, 848, 266

See application file for complete search history.

(56) References Cited

U.S. PATENT DOCUMENTS 1,484,520 A * 2/1924 Michod ..... E04B 2/58 52/432
1,757,359 A * 5/1930 Edwards ..... E04B 1/2403 403/300

(Continued)

FOREIGN PATENT DOCUMENTS

EP 1 621 692 2/2006

OTHER PUBLICATIONS

Italian Search Report cited in IT BS20120157 completed Aug. 22, 2013, 7 pages.

*Primary Examiner* — Brian Mattei
*Assistant Examiner* — Gisele Ford
(74) *Attorney, Agent, or Firm* — Nixon & Vanderhye P.C.

(57) ABSTRACT

A support framework (101) for building casings (200) using pultruded uprights, a building casing (200) and a building structure (300). Also described are a process for realizing and installation of the building structure (300), as well as manufacturing processes of the various components of the framework.

10 Claims, 36 Drawing Sheets

(51) Int. Cl.

| | |
|---|---|
| ***F24F 7/02*** | (2006.01) |
| ***E04D 13/17*** | (2006.01) |
| ***E04B 1/41*** | (2006.01) |
| *E04B 1/00* | (2006.01) |
| *E04B 1/24* | (2006.01) |
| *E04C 3/04* | (2006.01) |

(52) U.S. Cl.
CPC ..... *E04C 2003/0439* (2013.01); *E04C 2003/0452* (2013.01); *E04C 2003/0465* (2013.01)

(56) References Cited

U.S. PATENT DOCUMENTS 1,779,713 A * 10/1930 Percy ..... E04B 2/58 52/236.6
1,818,418 A 8/1931 Millard
1,858,701 A * 5/1932 Boettcher ..... E04B 1/74 52/284
1,970,965 A * 8/1934 Leake ..... E04B 1/2403 403/188
1,988,253 A * 1/1935 Pingenot ..... E04B 1/24 52/210
1,996,641 A * 4/1935 Coleman ..... E04B 1/24 52/263
2,382,584 A * 8/1945 Scheyer ..... F16B 31/021 105/414
4,121,391 A 10/1978 Schroeder
5,195,293 A * 3/1993 diGirolamo ..... E04B 1/24 52/745.13
5,412,913 A * 5/1995 Daniels ..... E04B 1/24 212/177
5,846,018 A 12/1998 Frobosilo et al.
2006/0254167 A1 11/2006 Antonic
2008/0307739 A1 12/2008 Clucas

* cited by examiner

| | |
|---|---|
| NAME OF STRUCTURE | |
| LOCALITY | LECCO (LC) |
| TYPE OF STRUCTURE | WALL |
| EXTERNAL WALL COLOUR | MEDIUM |
| | |
| NUMBER OF LAYERS | 10 |
| TOTAL THICKNESS | 0.392 m |
| TOTAL THERMAL RESISTANCE | 5.0488 $m^2KW$ |
| TOTAL THERMAL TRANSMITTANCE | 0.1981 $W(m^3K)$ |
| MAXIMUM TRANSMITTANCE (LAW DECREE 311 SINCE 2008) | 0.37 $W(m^3K)$ |
| MAXIMUM TRANSMITTANCE (LAW DECREE 311 SINCE 2010) | 0.34 $W(m^3K)$ |
| ATTENUATION | 0.3127 |
| TIME LAG | 8 HOURS 3 MINUTES |

| | Cat. | Material description | Thickness [mm] | Resistance [m²KW] | Density [kg/m³] | Spec. heat [J/kgK] |
|---|---|---|---|---|---|---|
| | | EXTERNAL SURFACE | | 0.0741 | | |
| | ROC | MARBLE | 0.02 | 0.0067 | 2700.00 | 836.80 |
| | INA | POORLY VENTILATED ROOM THICKNESS 50 mm | 0.05 | 0.08 | 1.00 | 1004.16 |
| | VAR | SHEET PLASTERBOARD | 0.0125 | 0.0595 | 900.00 | 836.80 |
| | ALI | CELLULOSE FIBRE SHEET | 0.06 | 1.60 | 30.00 | 1299.132 |
| | PLA | POLYESTER RESINS WITH GLASS FIBRE | 0.006 | 0.012 | 2000.00 | 1255.2001 |
| | INA | ROOM NOT VENTILATED THICKNESS 100 mm | 0.10 | 0.16 | 1.00 | 1004.16 |
| | INA | ROOM NOT VENTILATED THICKNESS 25 mm | 0.025 | 0.16 | 1.00 | 1004.16 |
| | PLA | POLYESTER RESINS WITH GLASS FIBRE | 0.006 | 0.012 | 2000.00 | 1255.2001 |
| | ALI | CELLULOSE FIBRE SHEET | 0.10 | 2.70 | 30.00 | 1299.132 |
| | VAR | SHEET PLASTERBOARD | 0.0125 | 0.0595 | 900.00 | 836.80 |
| | | INTERNAL SURFACE | | 0.125 | | |

FIG.33c

| | |
|---|---|
| NAME OF STRUCTURE | |
| LOCALITY | LECCO (LC) |
| TYPE OF STRUCTURE | WALL |
| EXTERNAL WALL COLOUR | MEDIUM |
| | |
| NUMBER OF LAYERS | 9 |
| TOTAL THICKNESS | 0.375 m |
| TOTAL THERMAL RESISTANCE | 7.7048 $m^2KW$ |
| TOTAL THERMAL TRANSMITTANCE | 0.1298 W/(m K) |
| MAXIMUM TRANSMITTANCE (LAW DECREE 311 SINCE 2008) | 0.37 $W(m^2K)$ |
| MAXIMUM TRANSMITTANCE (LAW DECREE 311 SINCE 2010) | 0.34 $W(m^3K)$ |
| ATTENUATION | 0.1653 |
| TIME LAG | 12 HOURS 22 MINUTES |

| | Cat. | Material description | Spessore [mm] | Resistenza [m²KW] | Densità [kg/m³] | Cal.spec. [J/kgK] |
|---|---|---|---|---|---|---|
| | | EXTERNAL SURFACE | | 0.0741 | | |
| | ROC | MARBLE | 0.02 | 0.0067 | 2700.00 | 836.80 |
| | INA | POORLY VENTILATED ROOM THICKNESS 50 mm | 0.05 | 0.08 | 1.00 | 1004.16 |
| | VAR | SHEET PLASTERBOARD | 0.0125 | 0.0595 | 900.00 | 836.80 |
| | ALI | CELLULOSE FIBRE SHEET | 0.06 | 1.60 | 30.00 | 1299.132 |
| | ALI | WOOD WOOL SHEET | 0.04 | 1.00 | 160.00 | 2099.9497 |
| | ALI | WOOD WOOL SHEET | 0.04 | 1.00 | 160.00 | 2099.9497 |
| | ALI | WOOD WOOL SHEET | 0.04 | 1.00 | 160.00 | 2099.9497 |
| | ALI | CELLULOSE FIBRE SHEET | 0.10 | 2.70 | 30.00 | 1299.132 |
| | VAR | SHEET PLASTERBOARD | 0.0125 | 0.0595 | 900.00 | 836.80 |
| | | INTERNAL SURFACE | | 0.125 | | |

FIG.34c

FIG.63
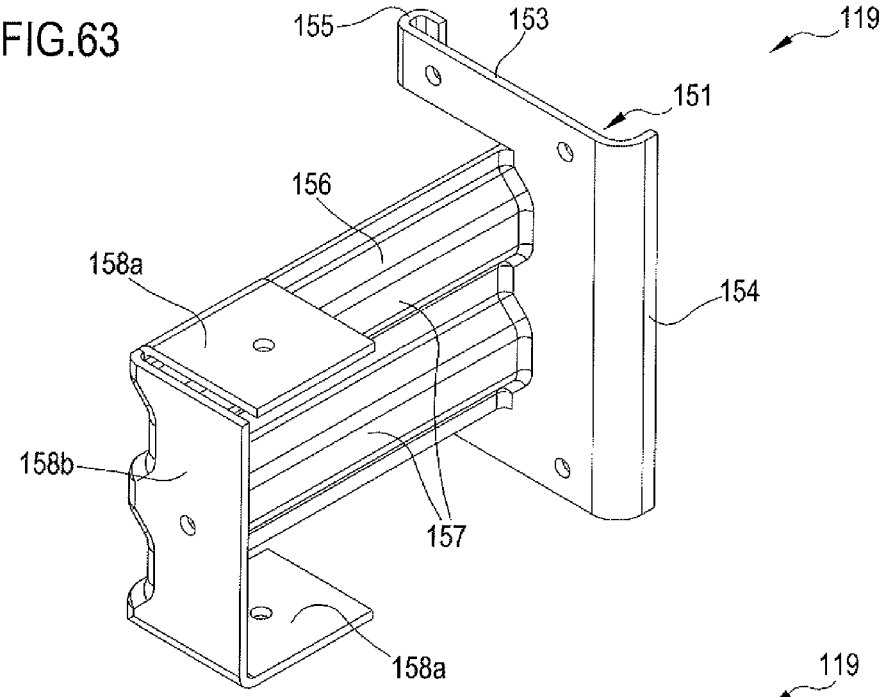
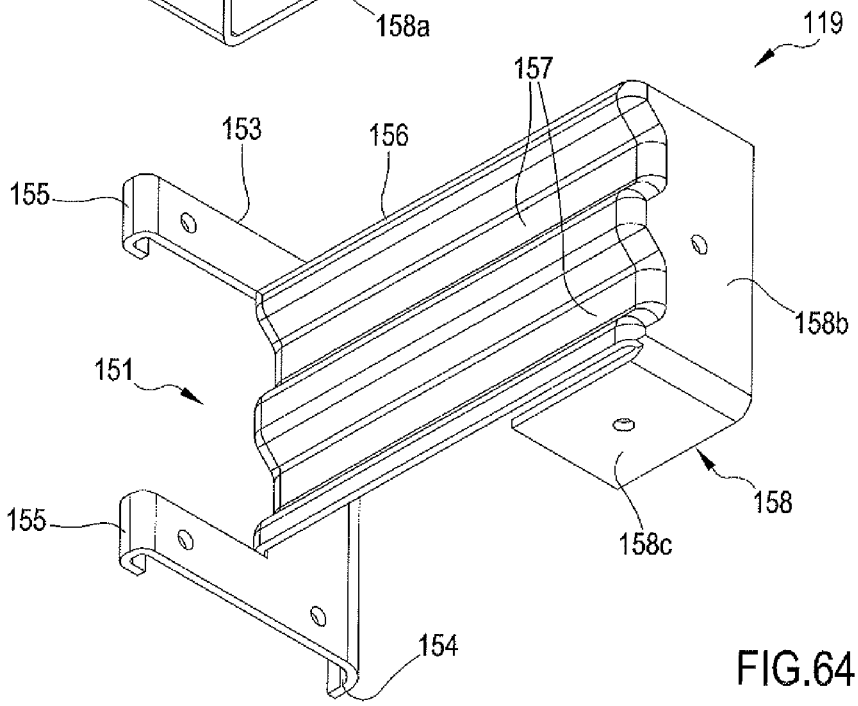
FIG.64

SUPPORT FRAMEWORK FOR BUILDING CASING, BUILDING CASING, BUILDING STRUCTURE AND METHOD FOR MANUFACTURING THEREOF

CROSS RELATED APPLICATIONS

This application is the U.S. national phase of International Application No. PCT/IB2013/059918 filed 5 Nov. 2013 which designated the U.S. and claims priority to Italian Patent Application No. BS2012A000157 5 filed on 5 Nov. 2012, the entire contents of each of which are hereby incorporated by reference.

FIELD OF THE INVENTION

The present invention relates to a support framework for building casings, a building casing and a dwelling structure comprising said framework. The present invention further concerns a process of realization of the building structure. The present invention can be applied both in the dwelling building sector and in the industrial building sector.

STATE OF THE ART

In the building sector, buildings are known that originate from a bearing structure—mainly comprising columns, beams and floors—which is closed internally of a cladding able to separate the inside of the building from the external environment. The casing is essentially constituted by a framework constrained to the bearing structure of the building and which stably engages the perimeter walls thereof (confining walls). The framework essentially defines a connecting element between the bearing structure and the perimeter walls and does not in fact constitute a structural element of the building.

At present essentially two different types of casings are known, defined wetwall and drywall construction.

A wet-wall structure (casing) can be obtained by casting a liquid concrete mixture into a bridge house (framework) made of foam polystyrene positioned perimetrally about the bearing structure of the building; in this way a layered perimeter wall structure is obtained, with reinforced concrete between two foam polystyrene layers. A further example of wet wall structure is constituted by perforated brick walls, mortared and defining the framework of the casing; the bricks are then filled with concrete.

Wet wall structures are substantially monolithic; once the concrete has dried, the wall is not modifiable if not with invasive and destructive interventions. The compact structure of this type of casing makes plant integration particularly problematic (arrangement of tubes, cables, electric switches, taps).

Generally the predisposing of the plant in the wet casings is based on the presupposition that the wall will be digged so as to realize dedicated housing compartment: these operations can be performed after the walls have been realized, with interventions including the partial breaking of the finishings and the walls.

Breaking walls means defining mechanically weakened zones and creating discontinuities in the heating and acoustic insulation. A further drawback of this type of wall is constituted by the poor resistance to seismic events (rigid structures): for this reason, in earthquake-prone zones, the walls are reinforced with special stiffeners.

As concerns drywall structures these are obtained at present by laying several layers of different materials about the framework of the casing; the materials are for example wood, plasterboard, Masonite and foam polystyrene. Dry casings are defined in this way because of the type of assembly between framework and the various layerings (panels), which is done by dry-jointing, for example using anchoring systems constituted by bolts, screws or welding.

A first example of a dry structure is described in patent application US 2006/0254167 A1 which concerns residential, commercial and industrial buildings. The casing comprises a framework constituted by a series of uprights which can be realized using a composite material; the uprights define a support structure able to engage a series of closure panels predisposed to separate the internal environment of the building from the external environment.

A second example of dry structure is described in patent application US 2011/0030296 A1 relating to a framework constituted by a series of uprights each of which is able to connect, at the ends thereof, to a first and a second floor deck, consecutive to one another. The uprights therefore define, between two consecutive floors, anchoring elements for the various layers which will define the lateral wall of the building.

Dry systems are also not free of drawbacks. In fact, even wall structures made using dry methods suffer from poor plant-integrating properties (for example electrical and hydraulic plant): in fact eventual modification to plants at times subsequent to their installation are difficult to carry out.

A further limitation of the dry structures at present known is constituted by the high coefficient of heat conductivity of the wall: dry casings do not provide sufficient heat insulation of rooms of the building with respect to the outside. For this reason very often the walls are clad with layers of insulating materials. Dry walls also provide an inadequate acoustic insulation.

Drywall structures further suffer from poor mechanical characteristics (they cannot bear heavy loads): in fact the loads applicable to drywalls are always very small, for example furnishings, shelving or the like.

AIM OF THE INVENTION

An aim of the present invention is therefore substantially to obviate at least one of the drawbacks and/or limitations in the preceding solutions.

A first aim of the invention is to provide a support framework that is resistant to static and dynamic loads and is provided with good characteristics of heat and acoustic insulation.

A further aim is to provide a framework that is easy to install.

A further aim of the invention is to provide a support framework that is able to guarantee a simple and rapid integration of the building plant, for example hydraulic and electric plant, without seriously damaging the casing or creating zones where the heat and acoustic insulation is reduced.

A further aim of the invention is to provide a casing for civil or industrial buildings which uses the support framework of the invention.

Lastly, an aim of the invention is to provide an installing a support framework for realizing a building casing and/or a building using the building casing.

SUMMARY

One or more of the above-described aims, which will more fully emerge during the course of the present description, are substantially attained by a support framework according to one or more of the appended claims.

One or more aims of the invention are also attained by a manufacturing process and/or an installation of the support framework, according to one or more of the claims.

Lastly, the aims of the invention are attained by a casing and a dwelling structure according to one or more of the appended claims.

BRIEF DESCRIPTION OF THE DRAWINGS

Some embodiments and aspects of the invention will be described in the following with reference to the accompanying drawings, provided by way of non-limiting example, in which.

Figure 1:
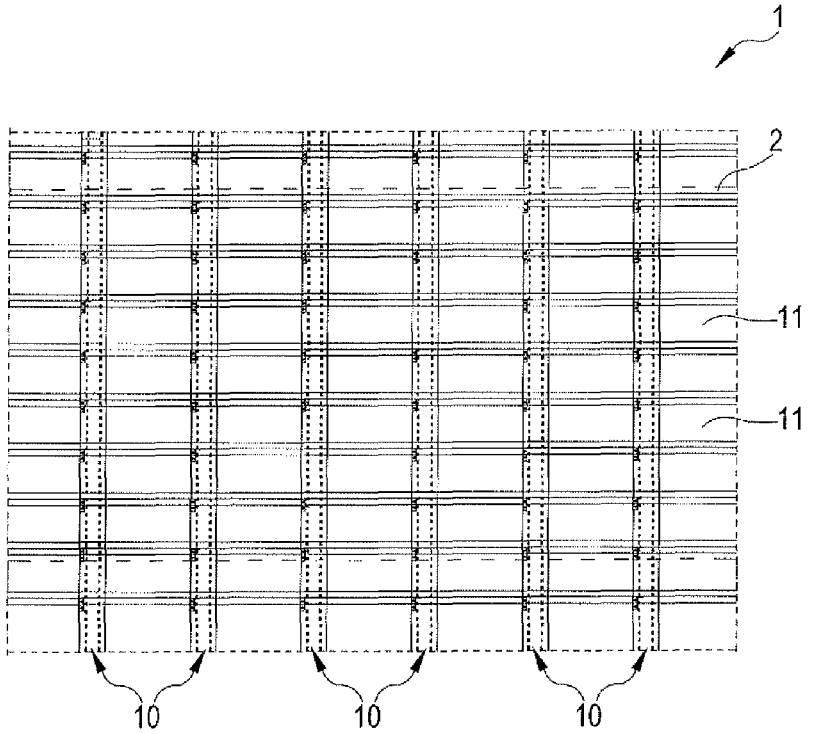
FIG. 1 is a schematic elevation view of a wall structure according to the present invention.
Figure 11A:
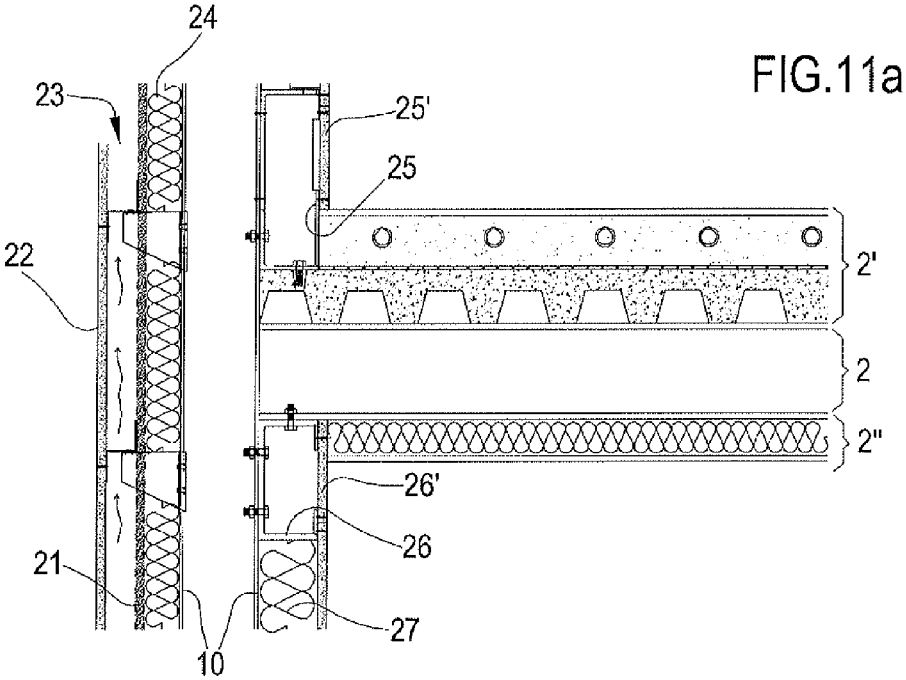
Figure 11C:
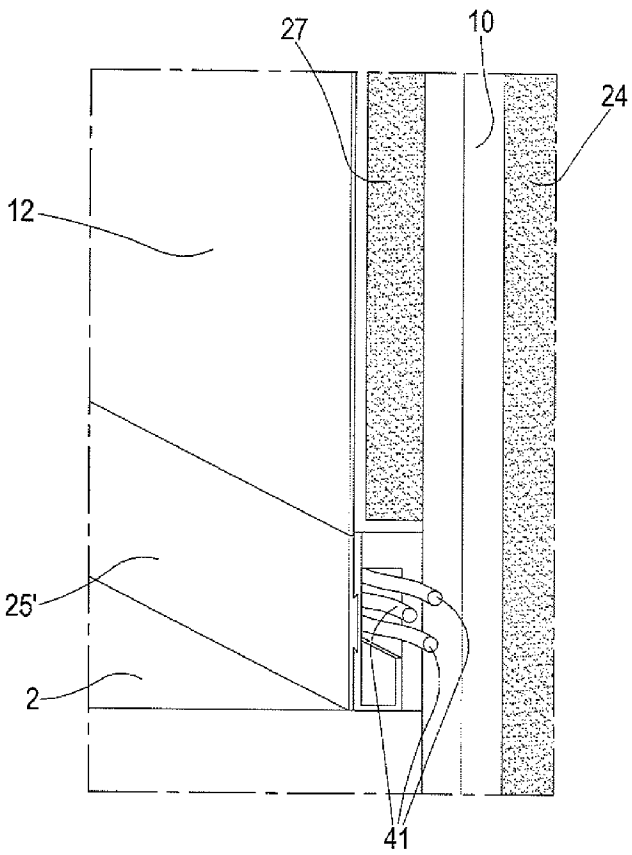
Figure 11B:
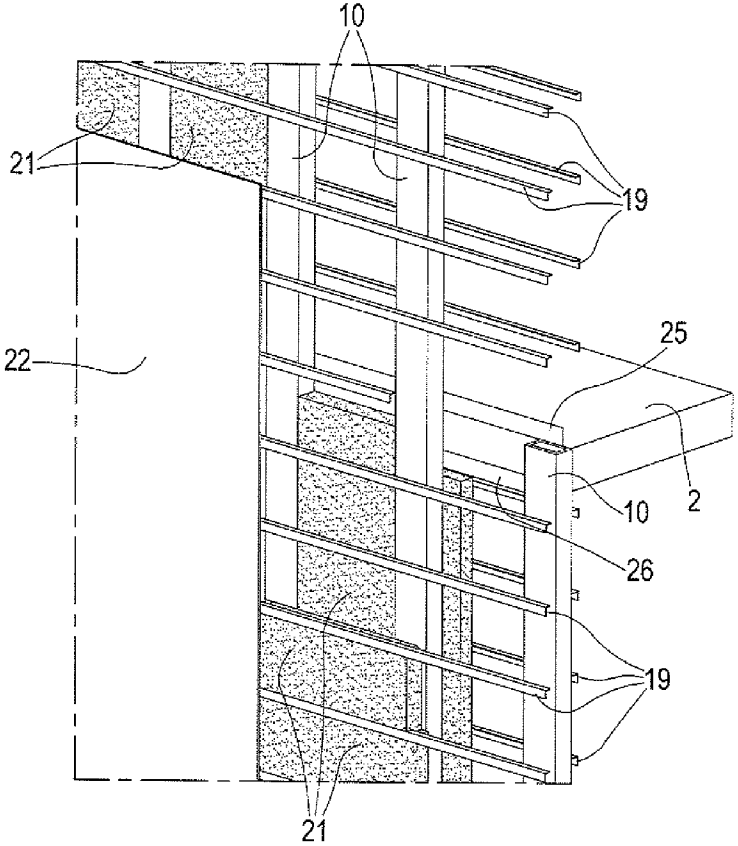
Figure 12:
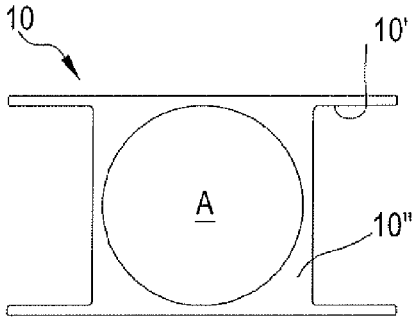
Figure 13:
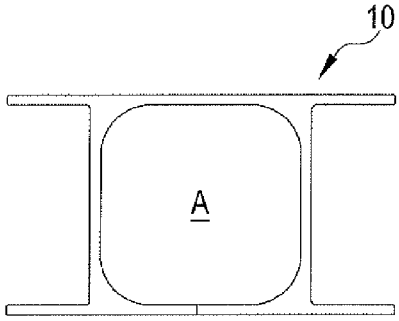
Figure 14:
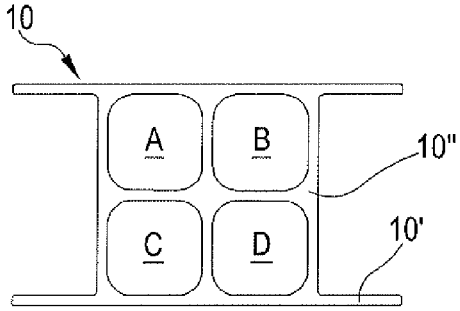
Figure 15:
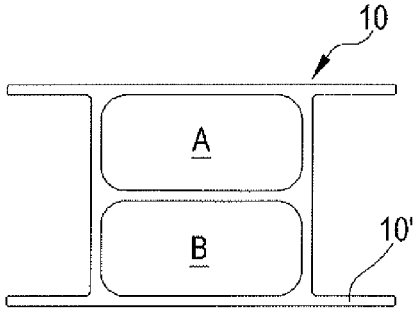
Figure 16:
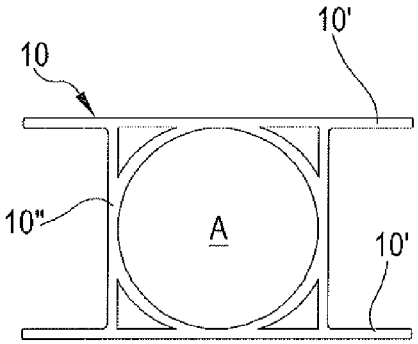
Figure 17:
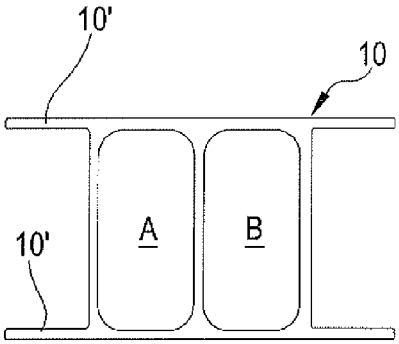
Figure 25:
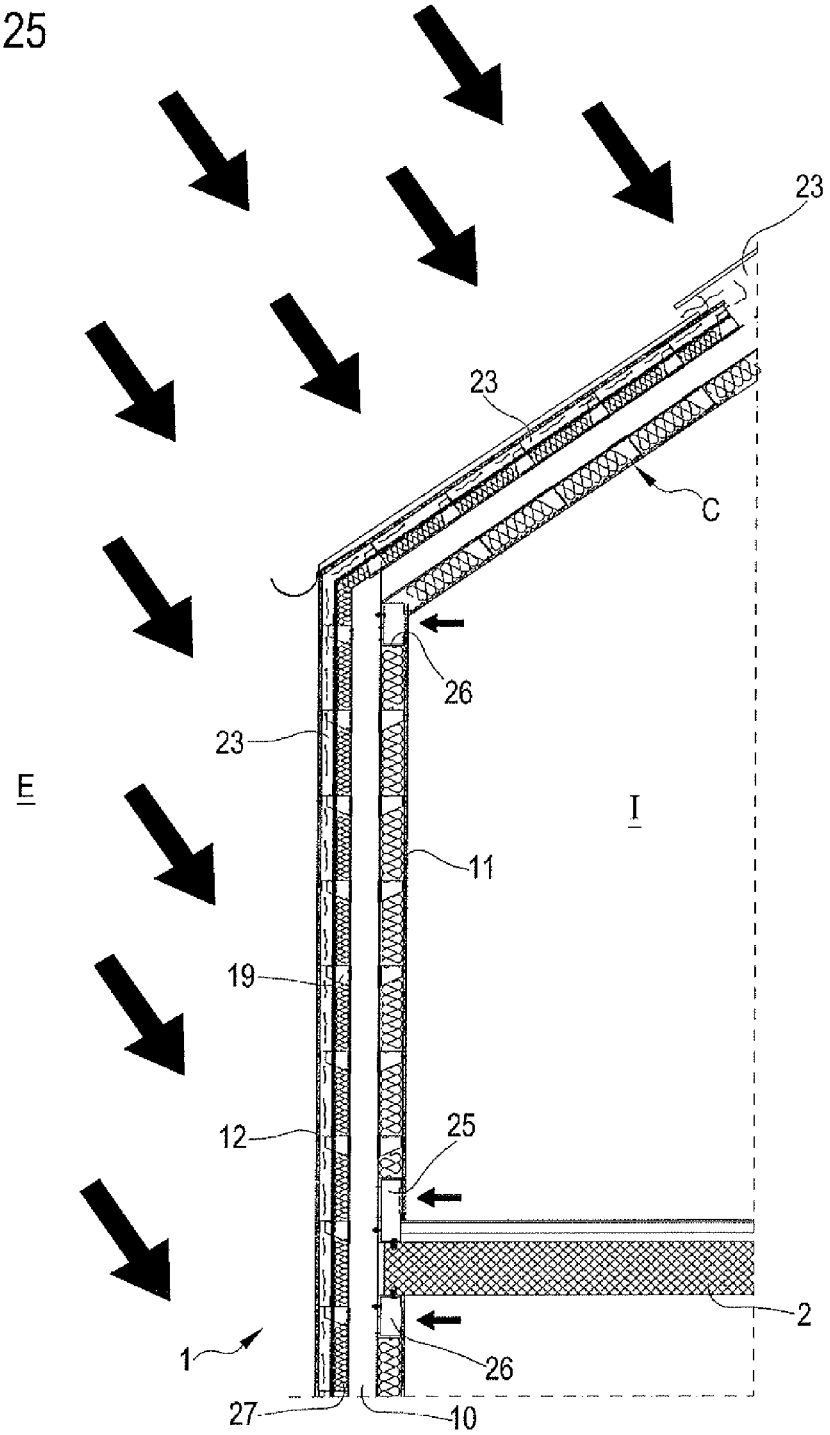
Figure 26:
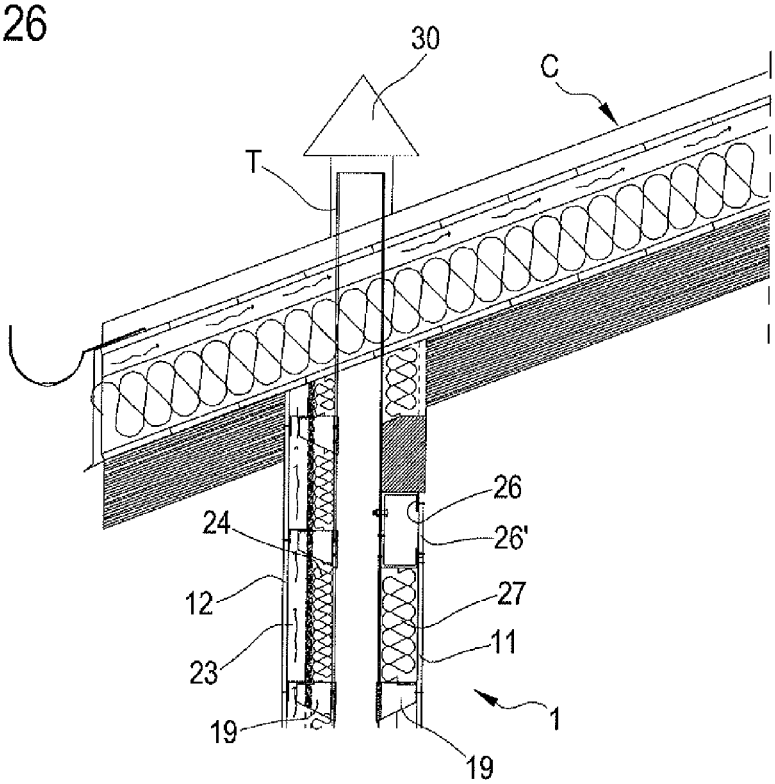
Figure 27:
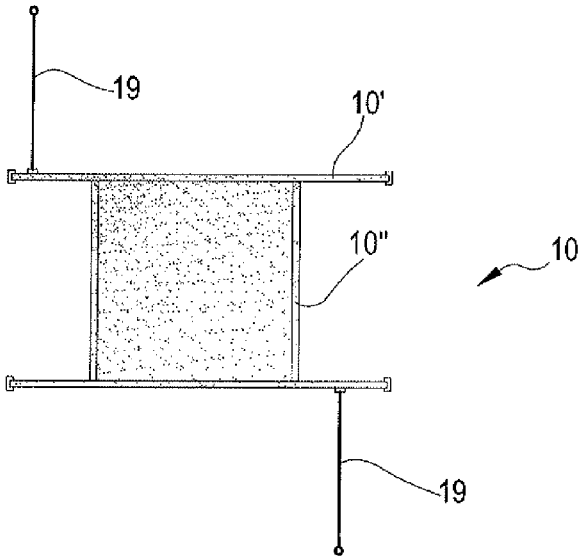
Figure 28:
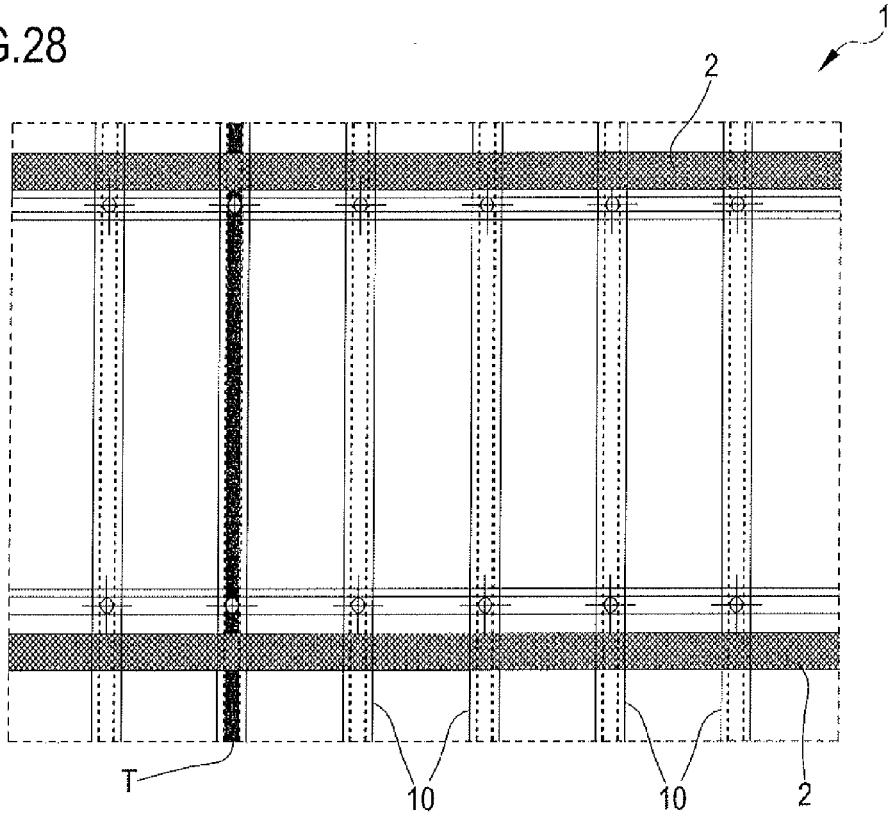
Figure 29:
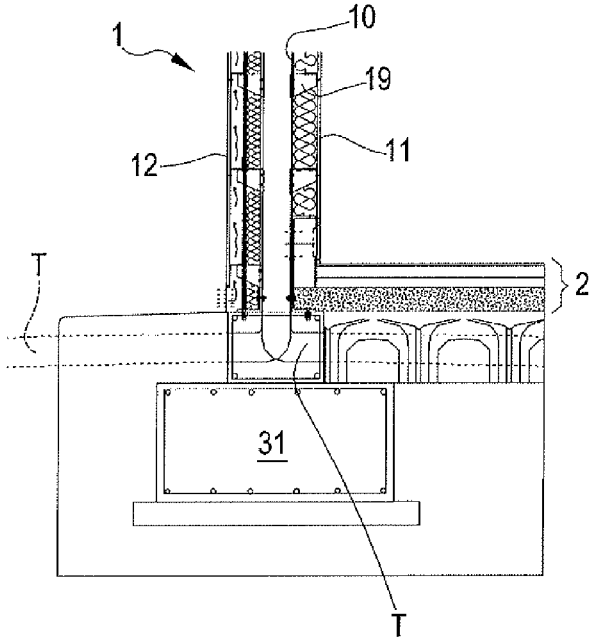
Figure 30:
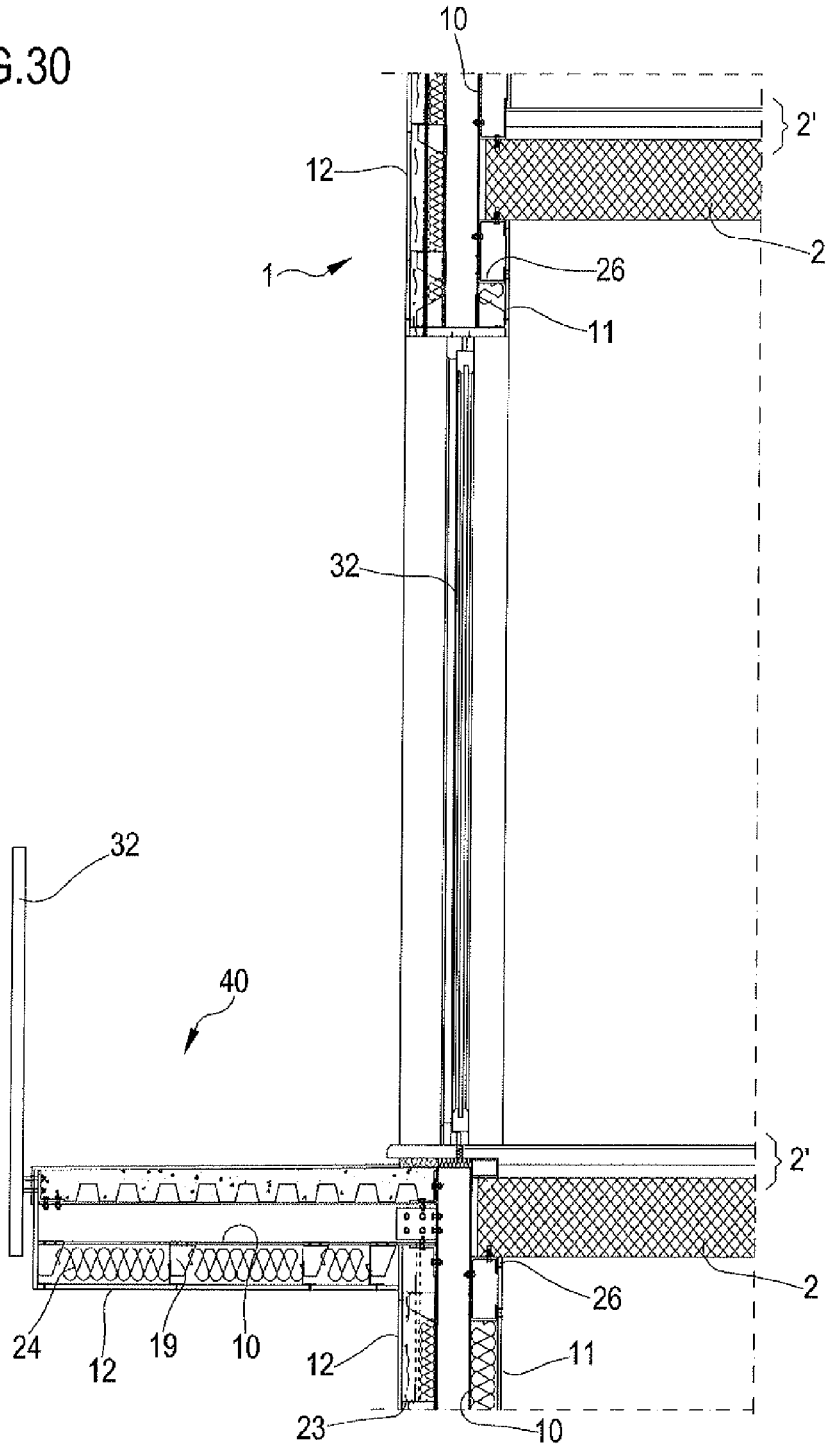
Figure 31:
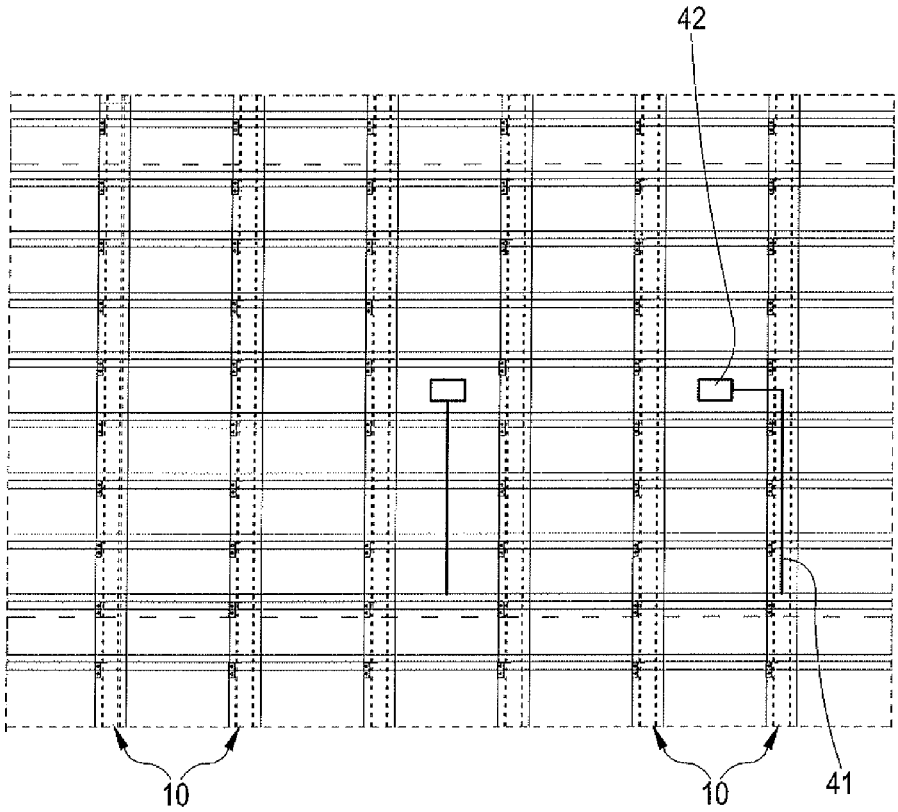
Figure 32:
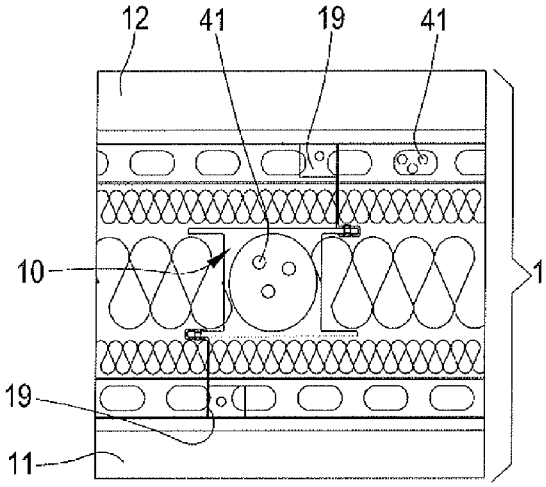
Figures 33A, 33B:
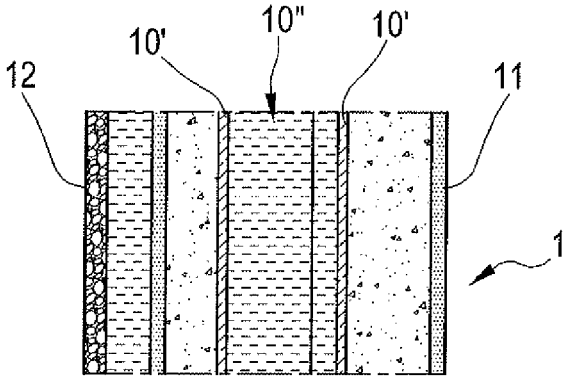
Figure 33D:
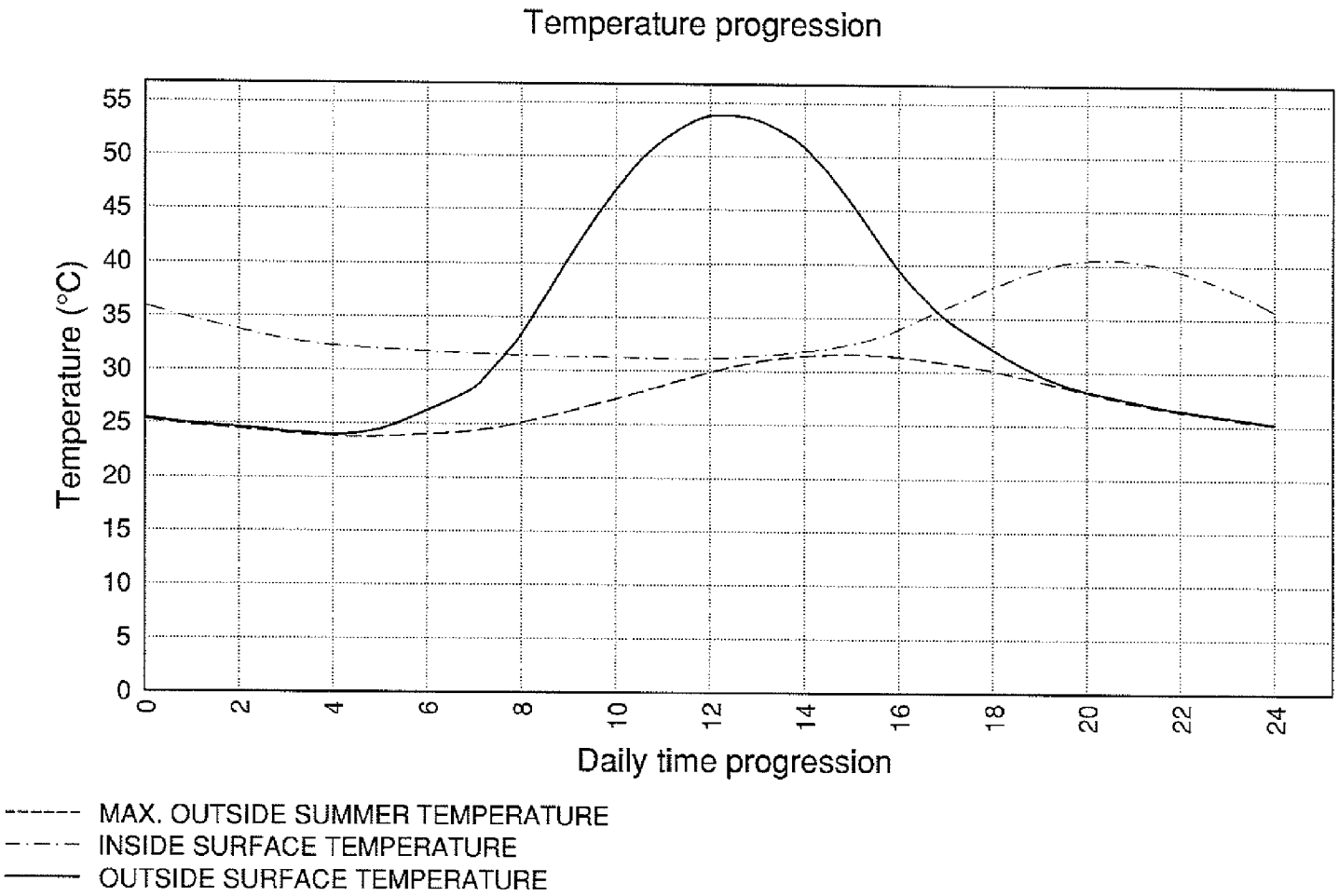
Figures 34A, 34B:
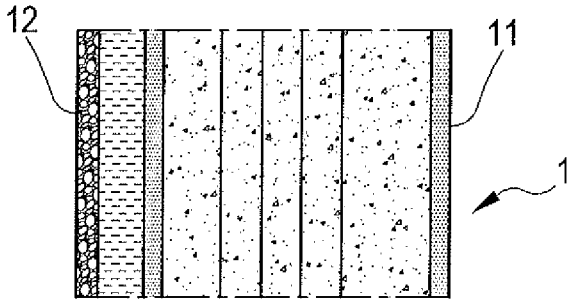
Figure 34D:
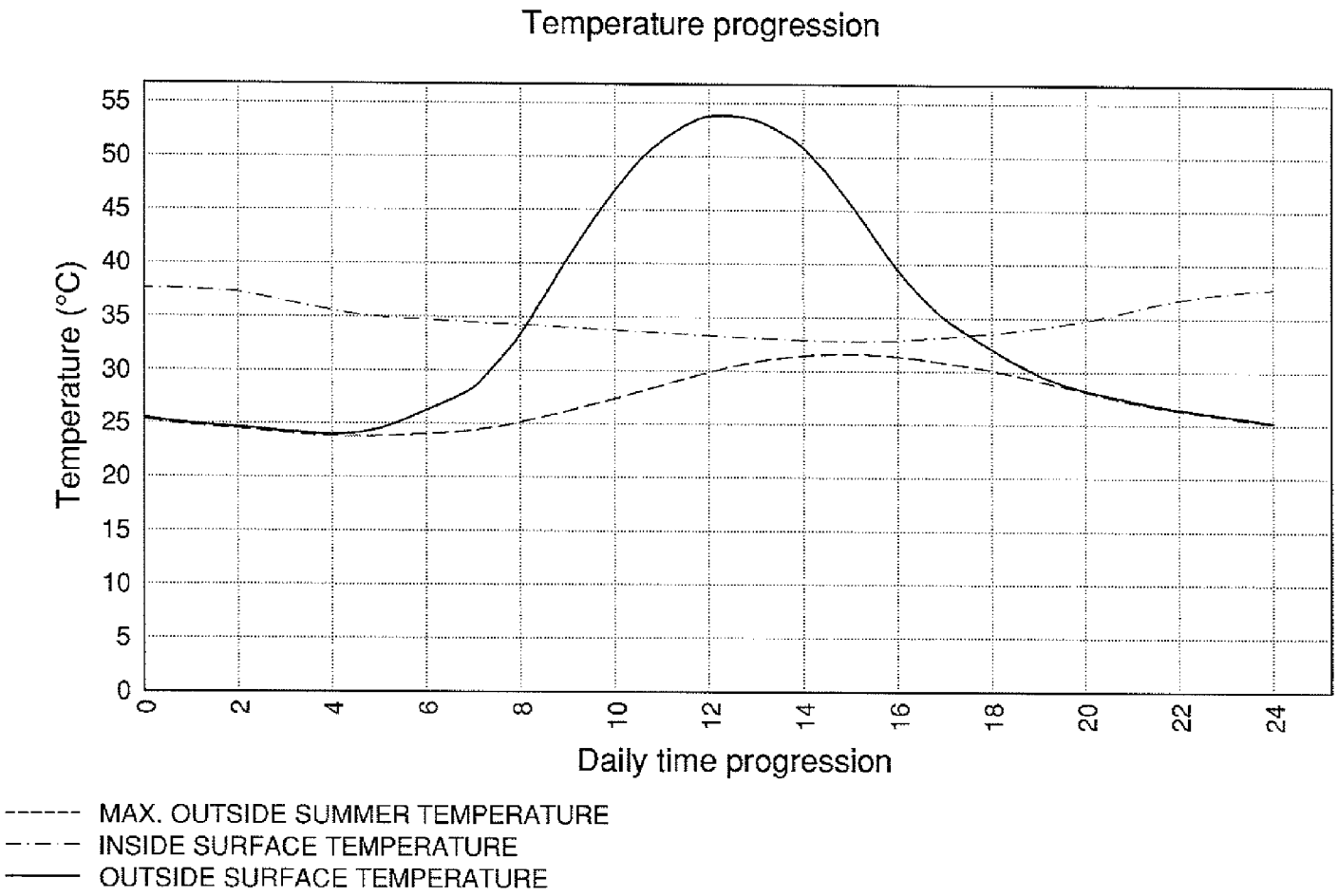
Figure 35:
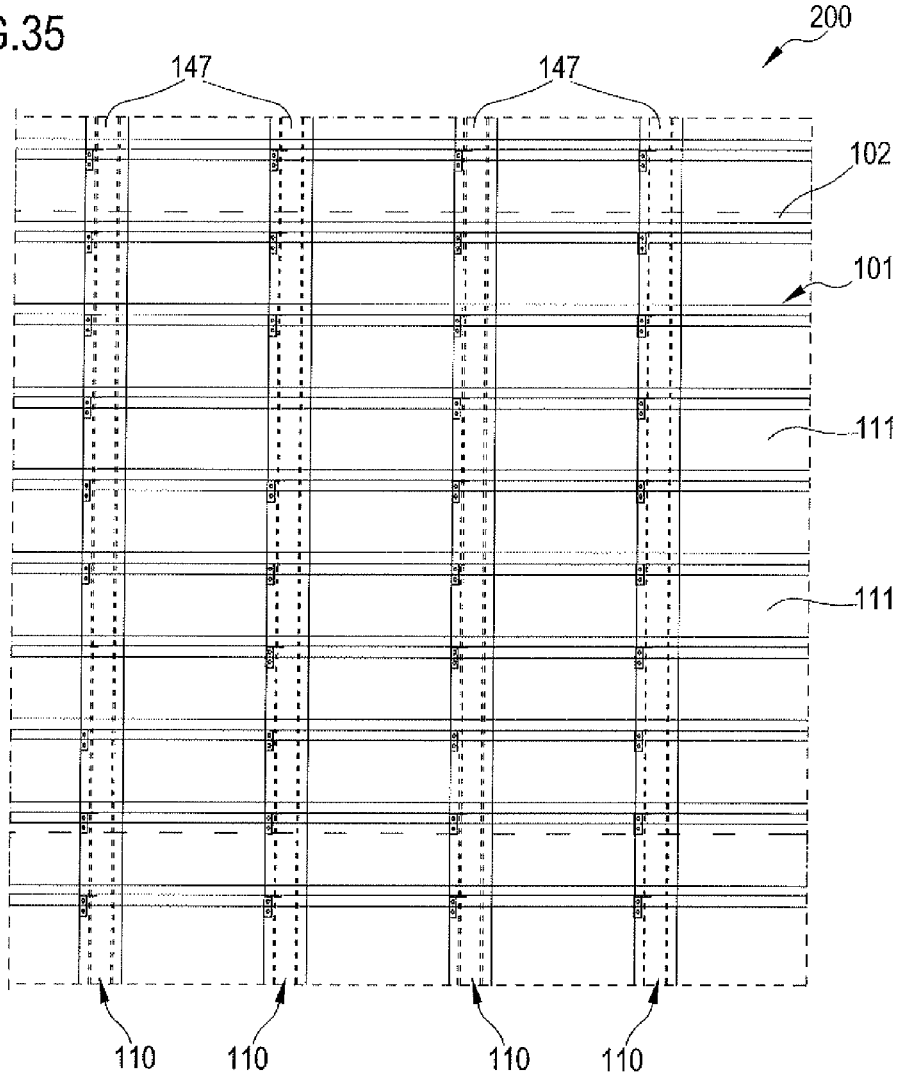
Figure 36:
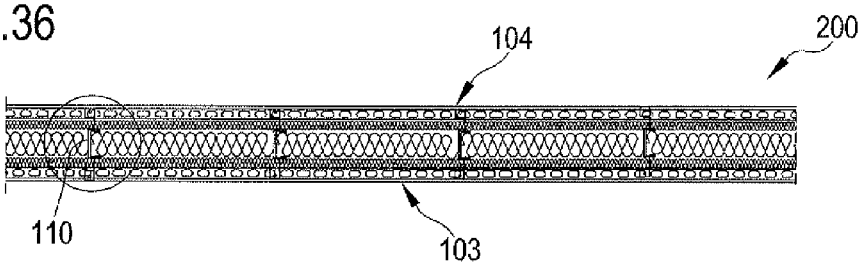
Figure 37:
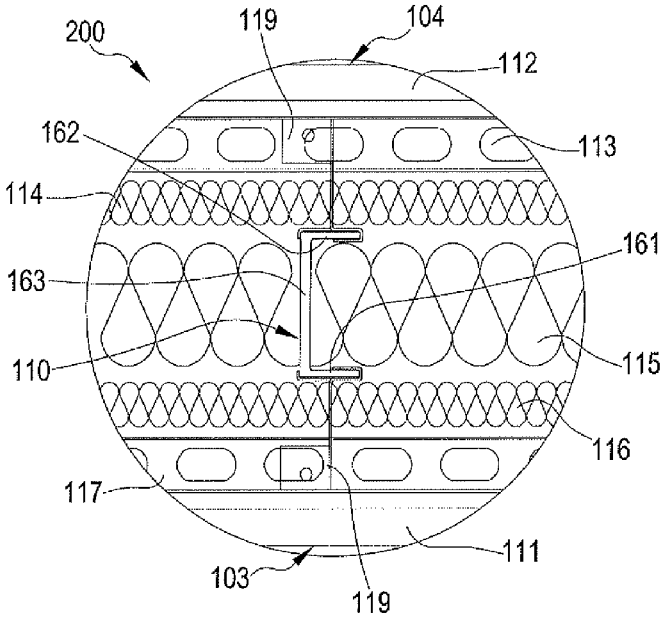
Figure 38:
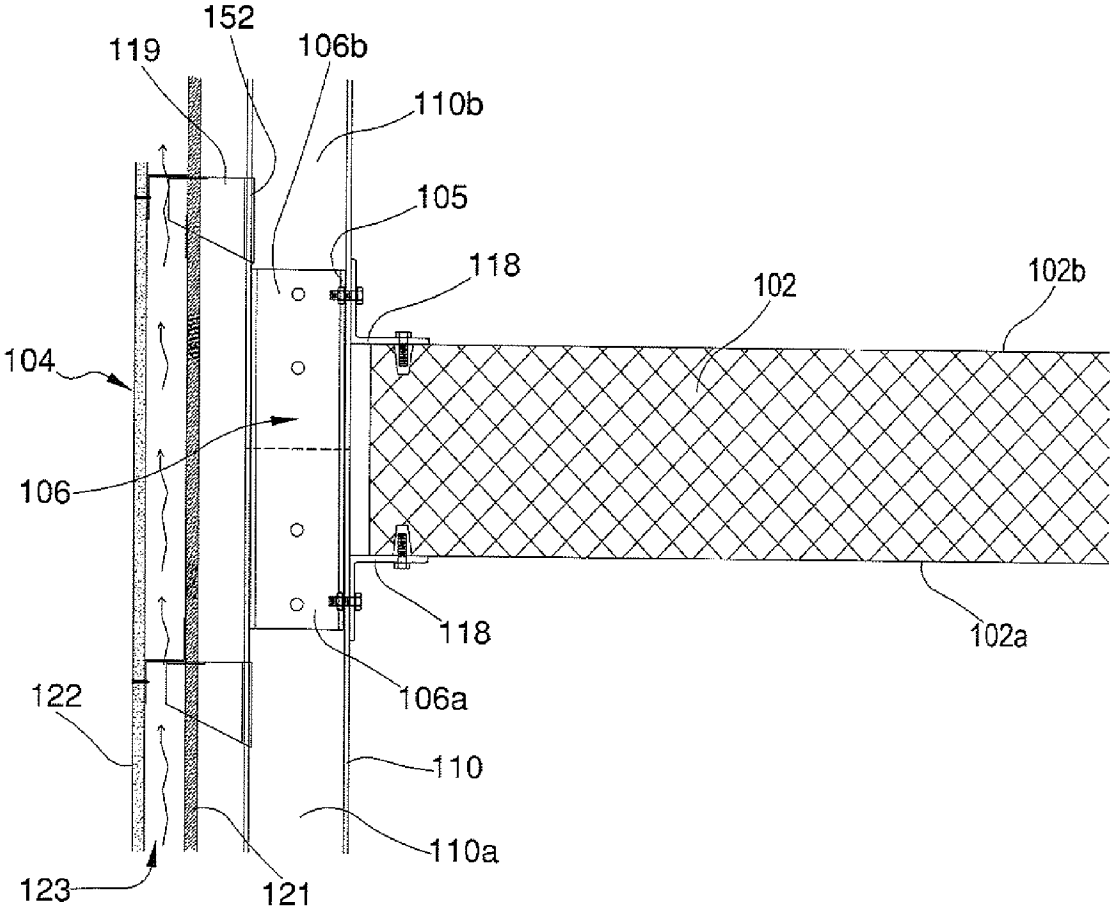
Figure 39:
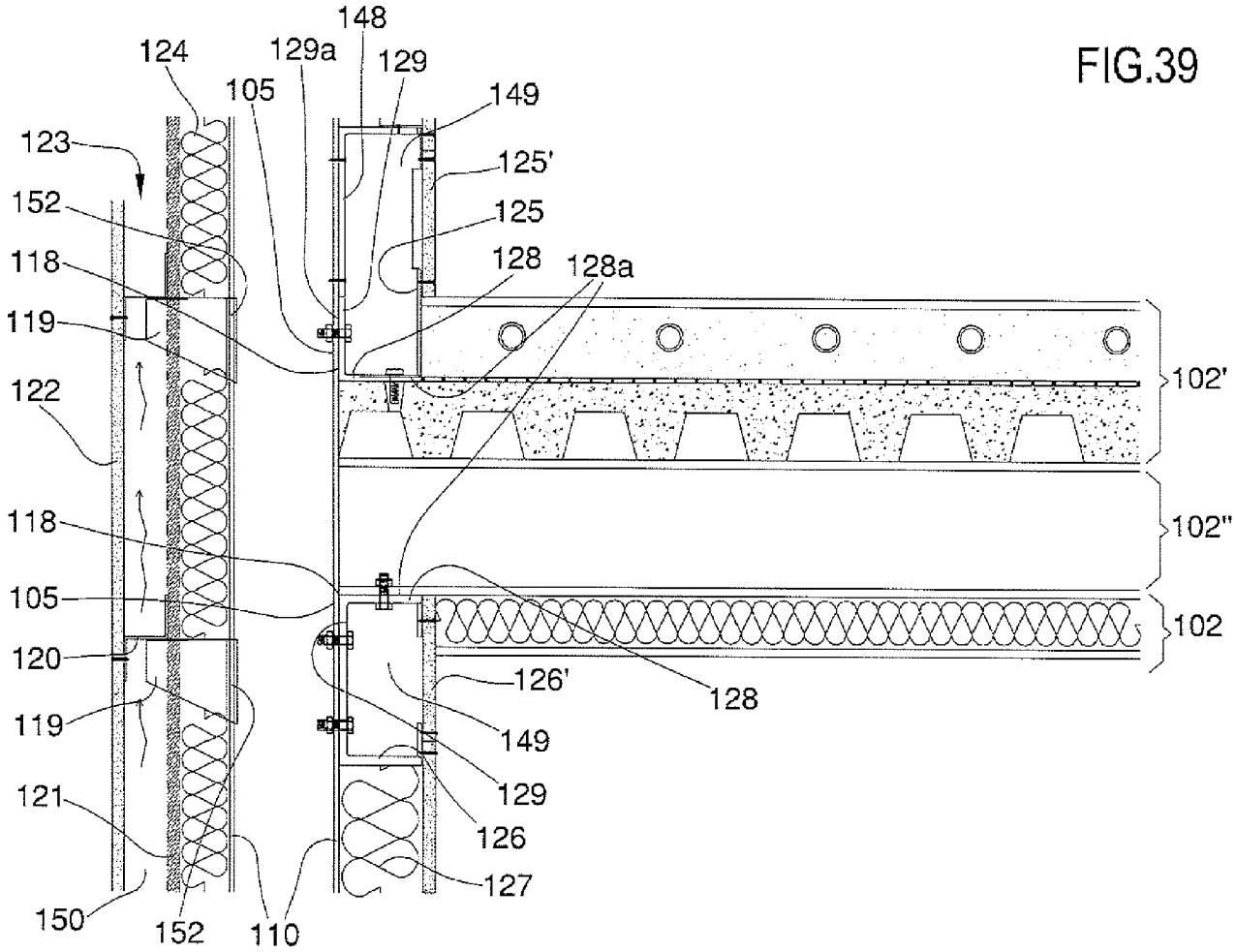
Figure 40:
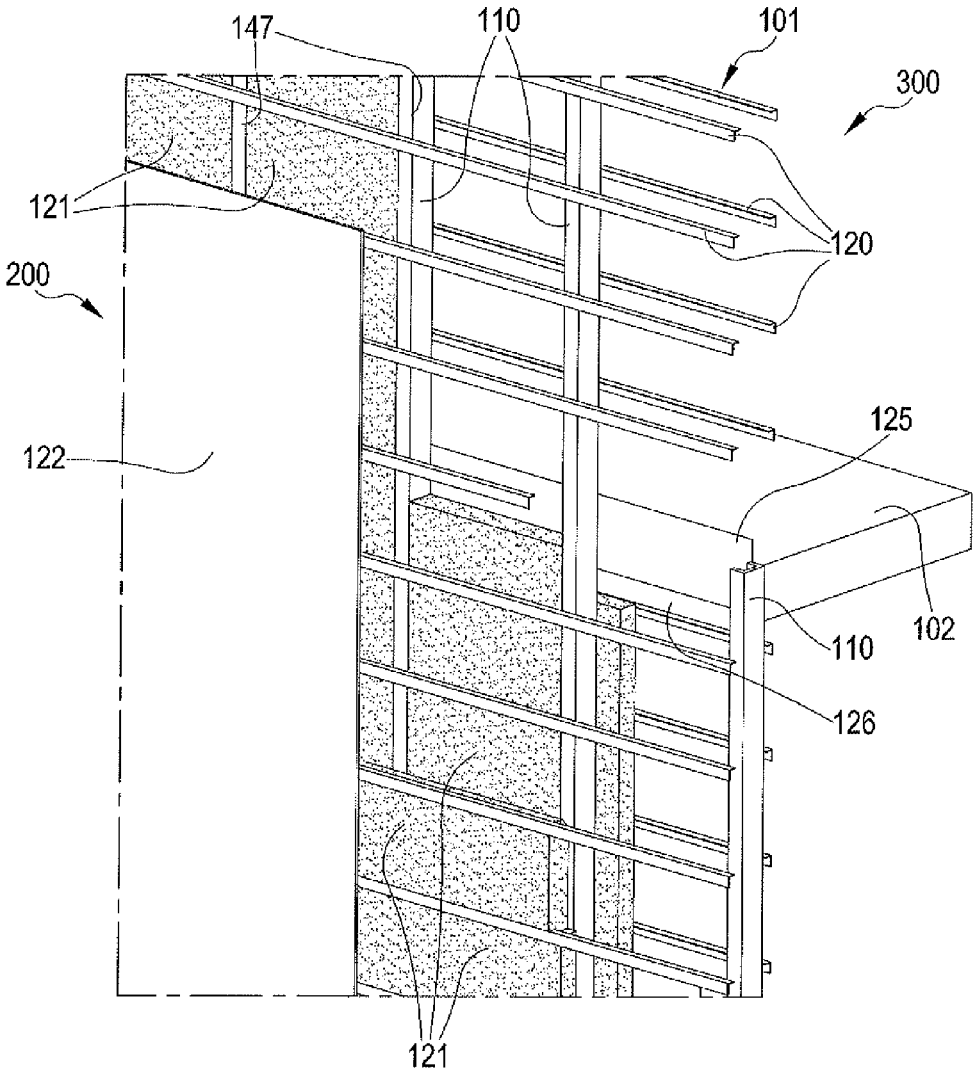
Figure 41:
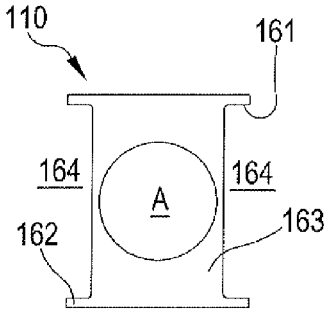
Figure 42:
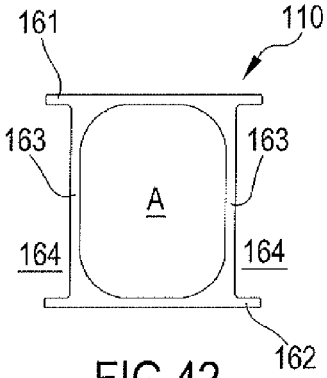
Figure 43:
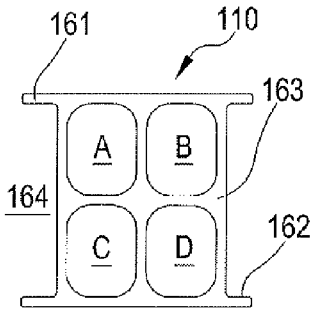
Figure 44:
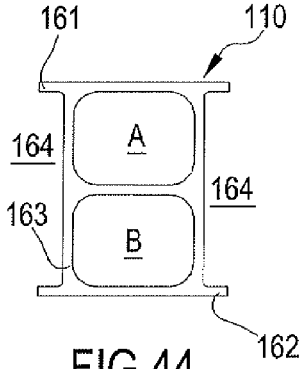
Figure 45:
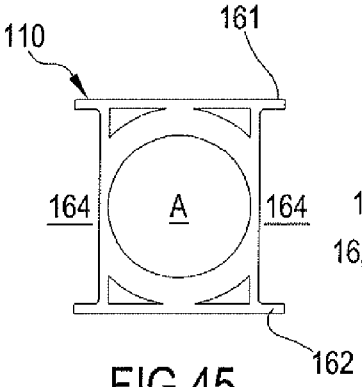
Figure 46:
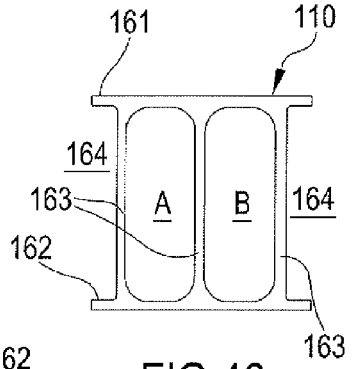
Figure 47:
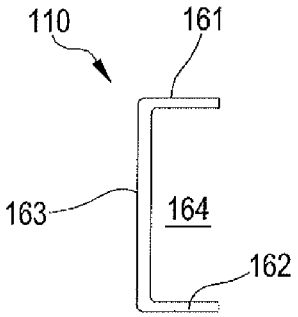
Figure 48:
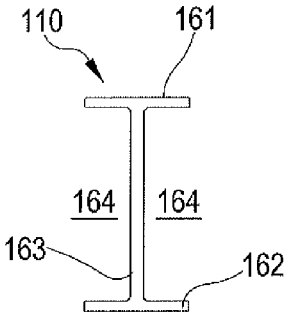
Figure 49:
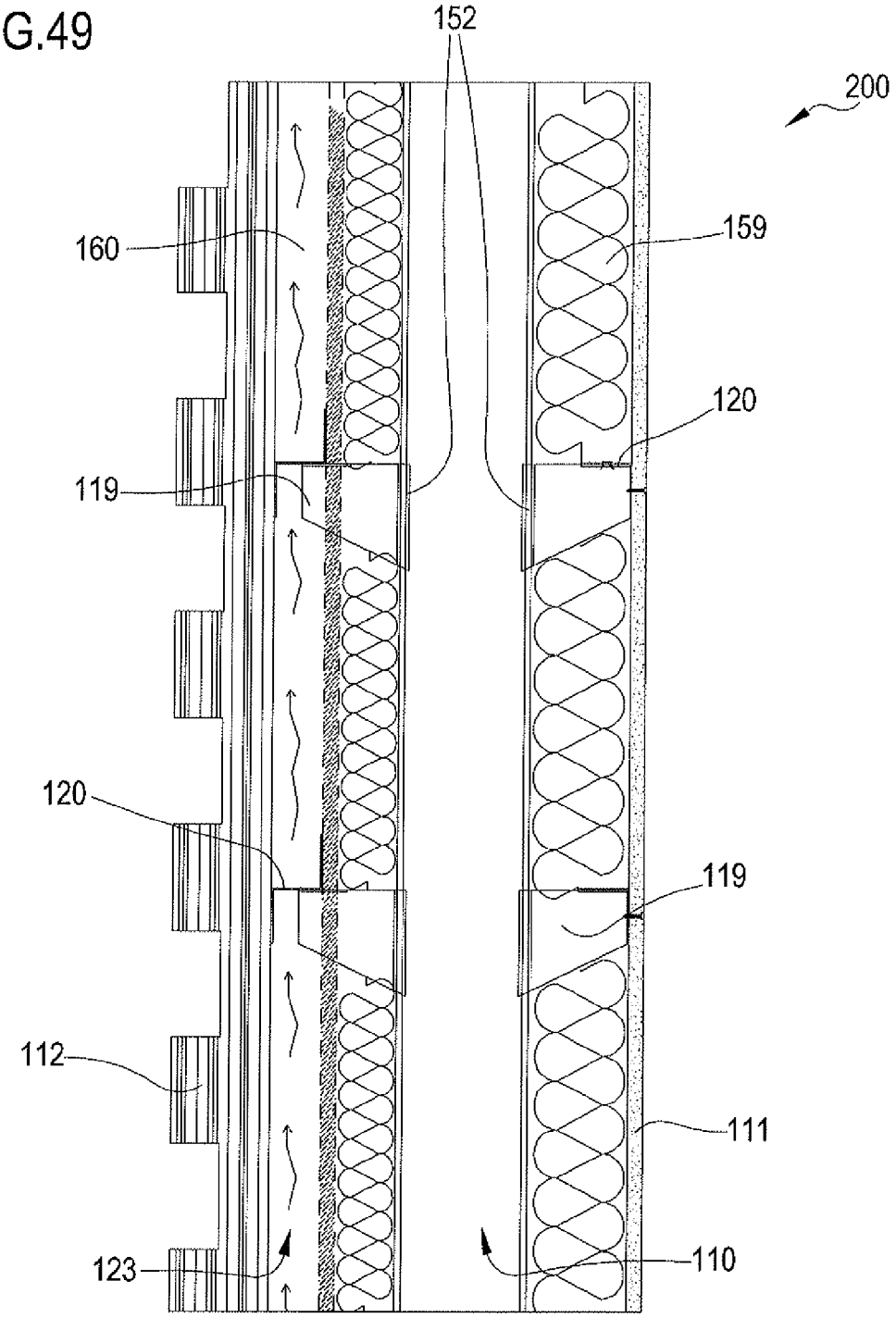
Figure 50:
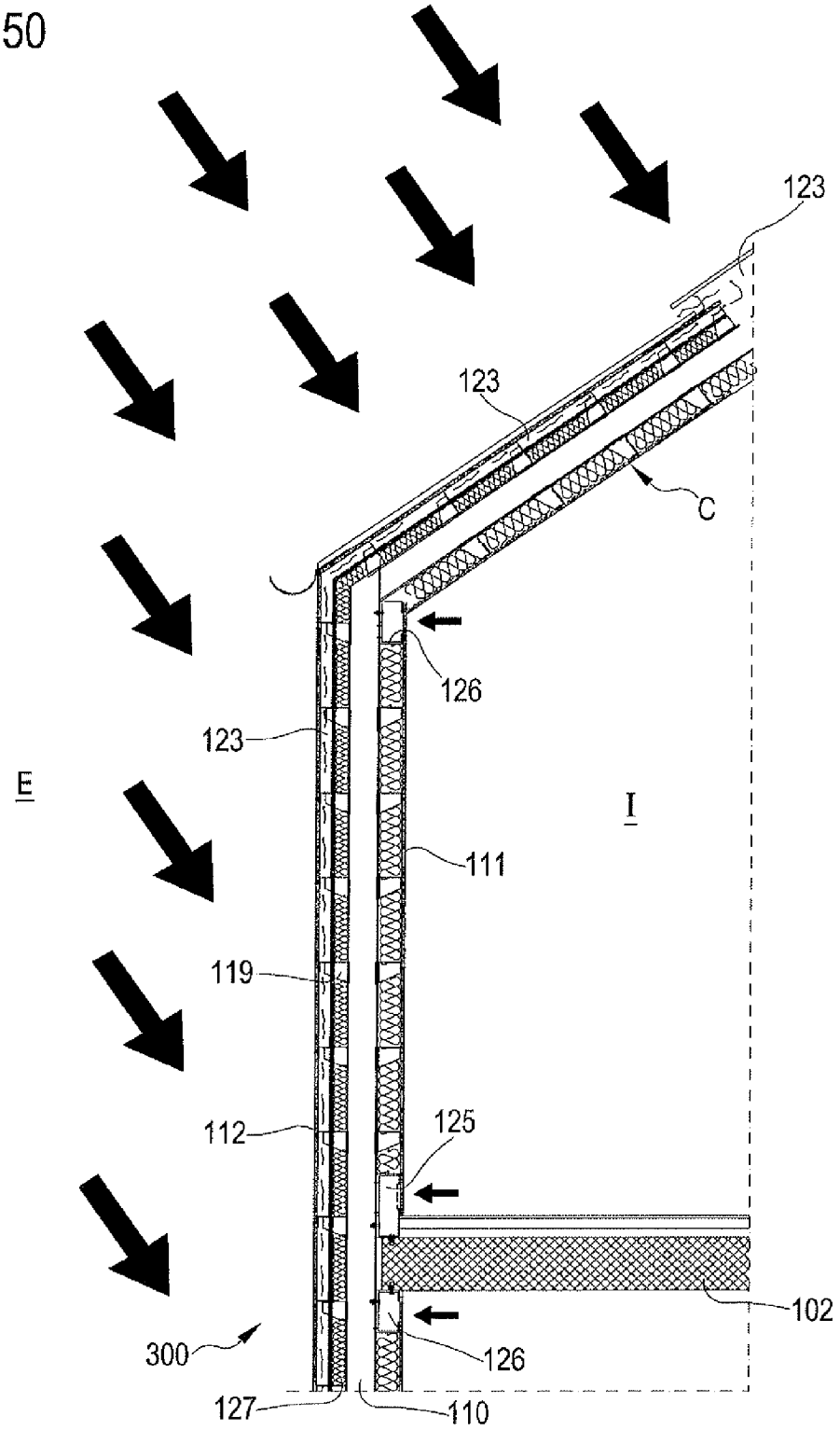
Figure 51:
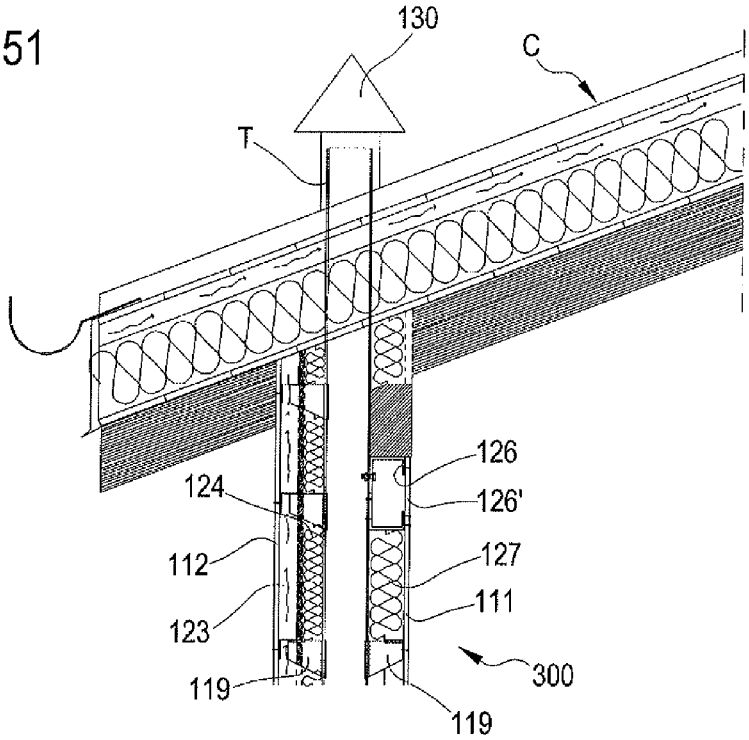
Figure 52:
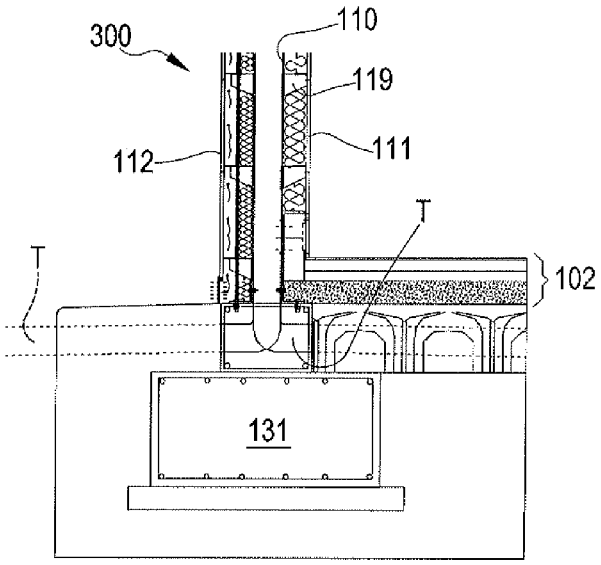
Figure 53:
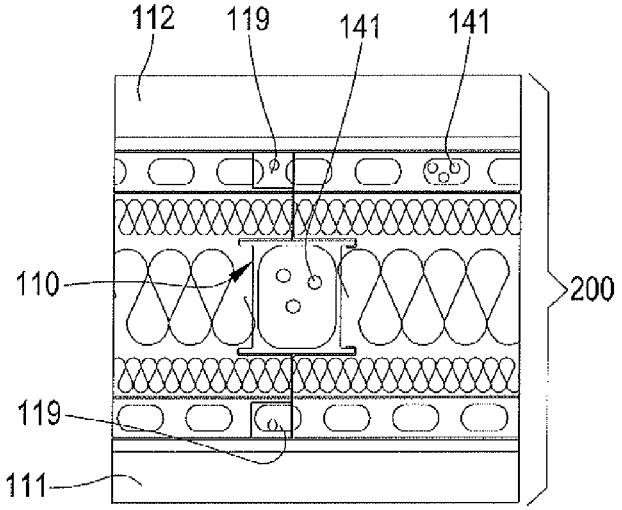
Figure 54:
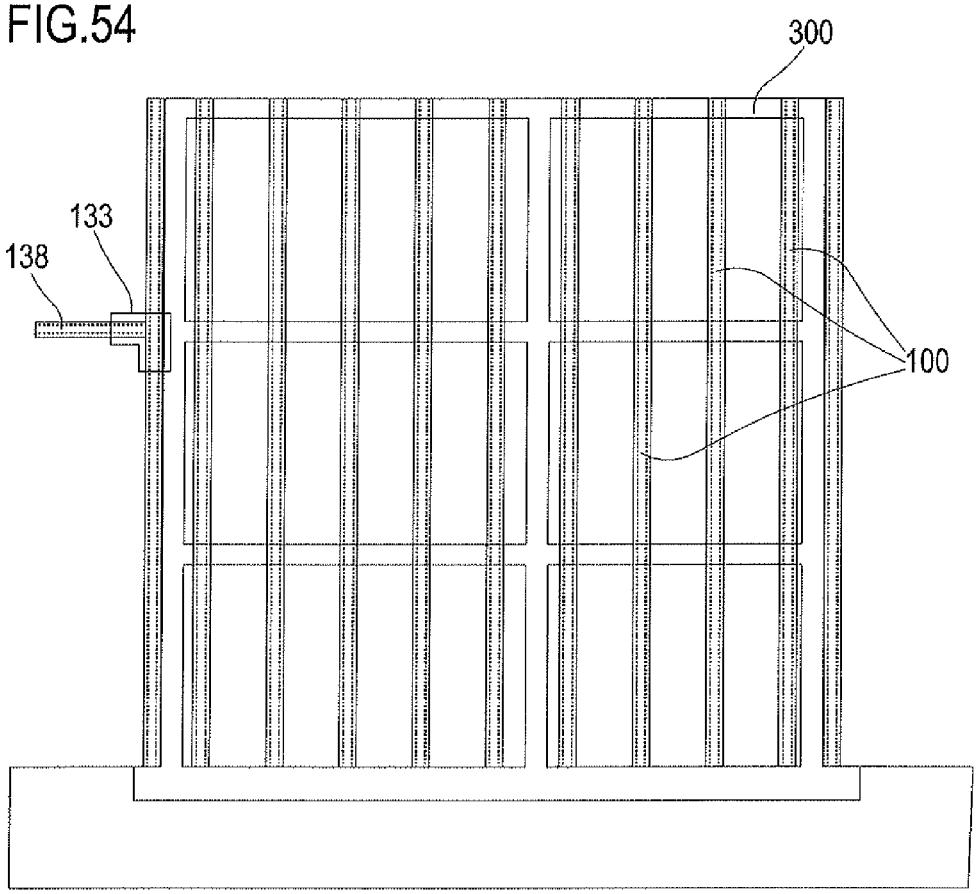
Figure 55:
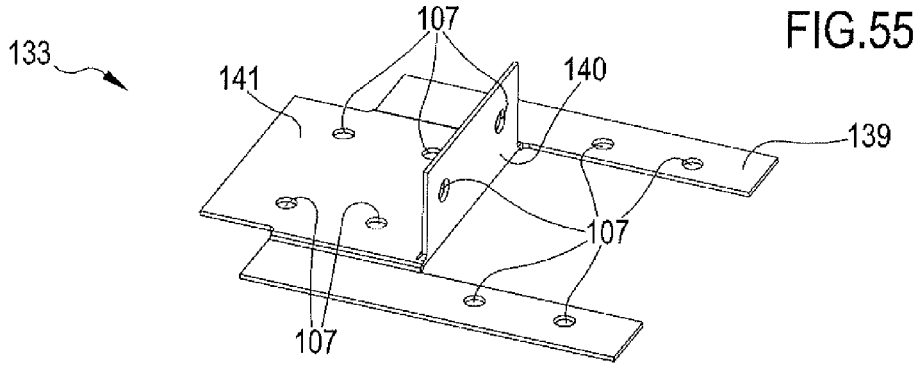
Figure 56:
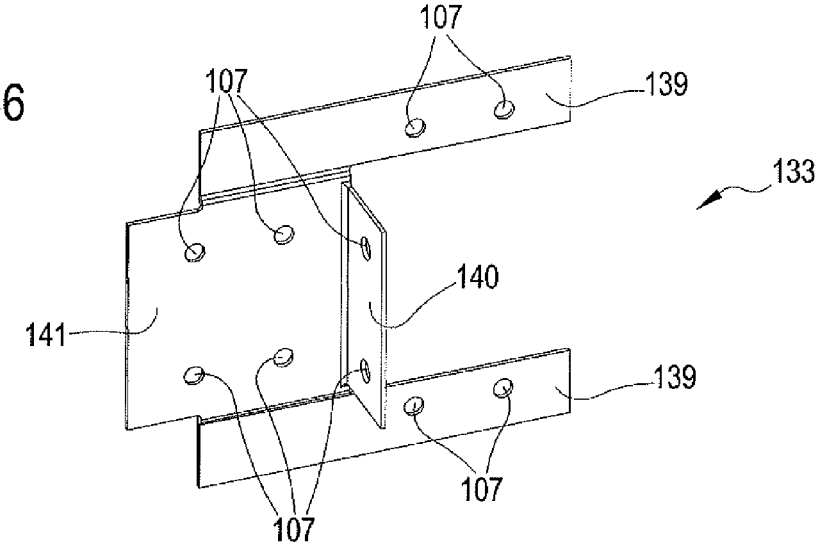
Figure 57:
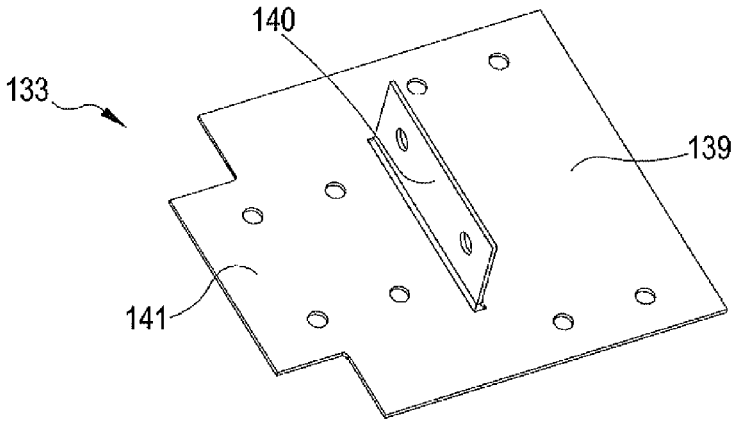
Figure 58:
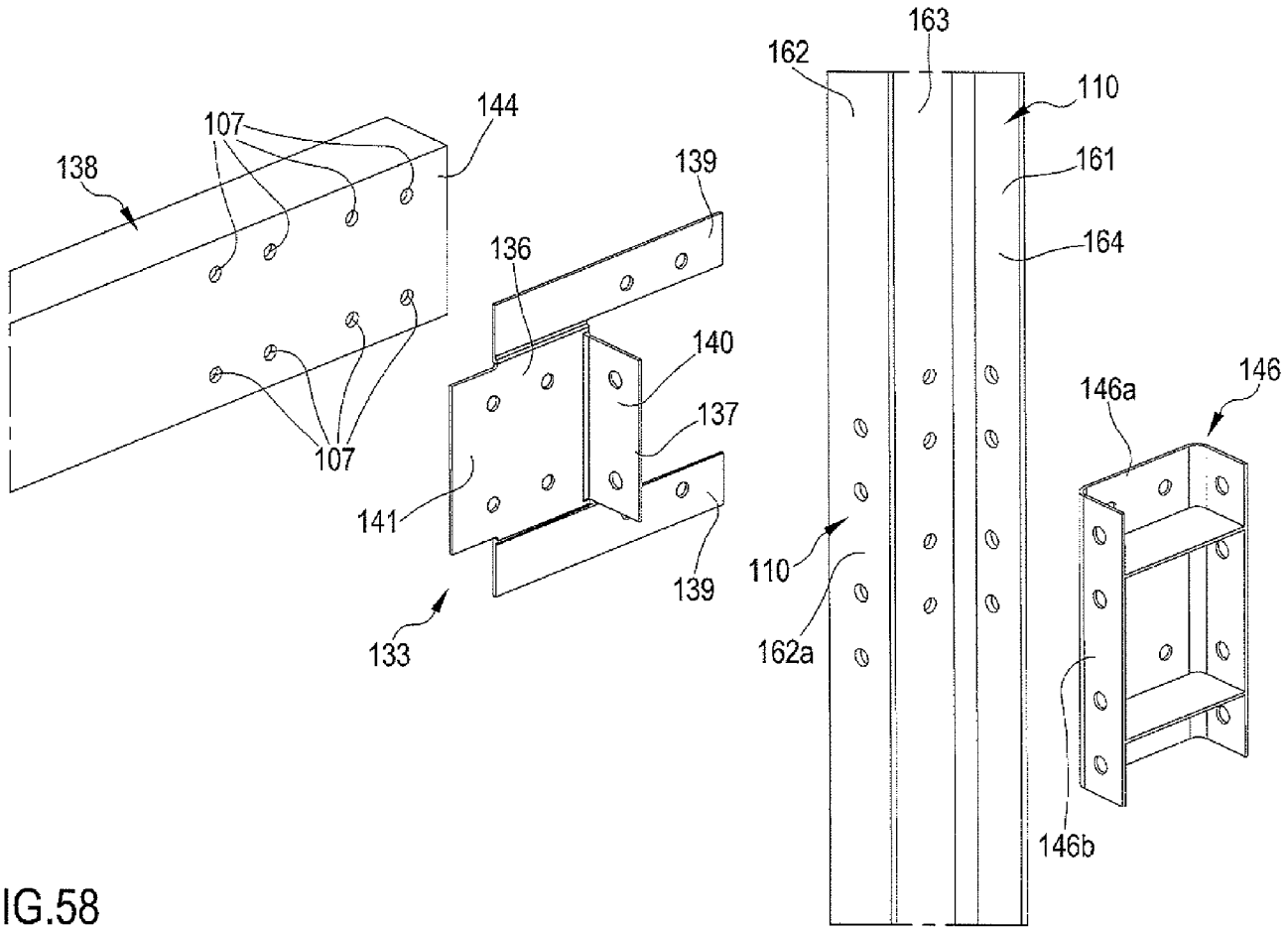
Figure 60:
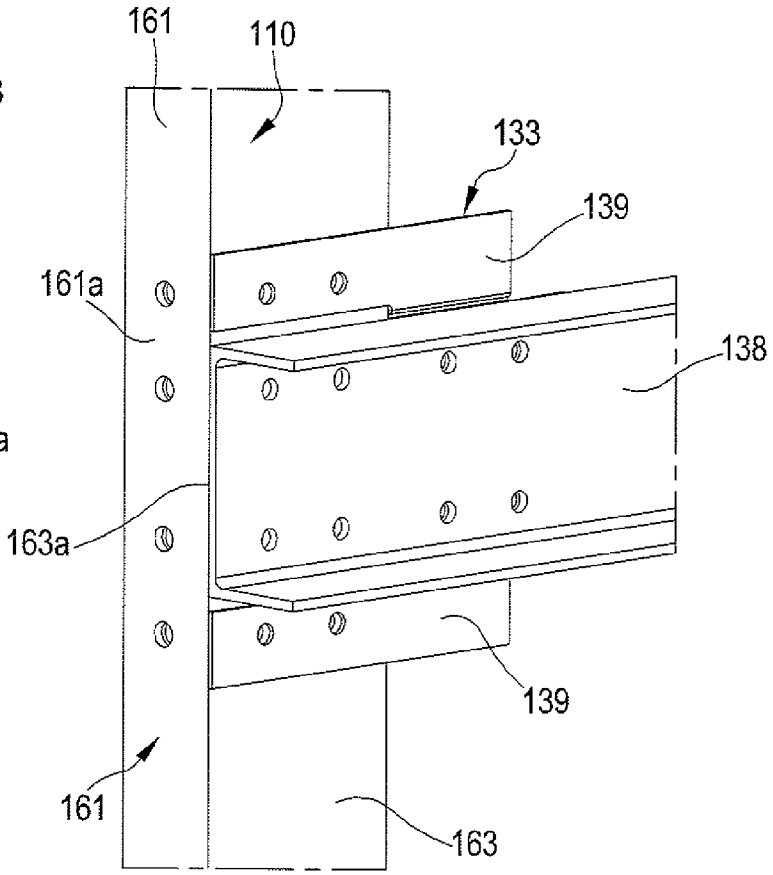
Figure 59:
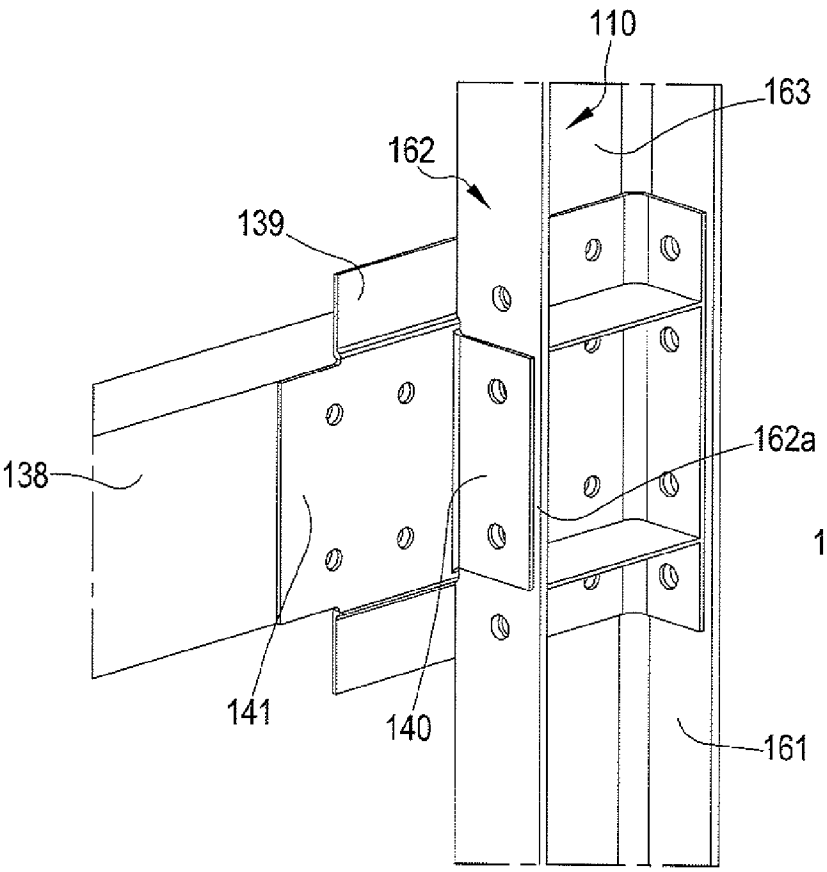
Figure 61:
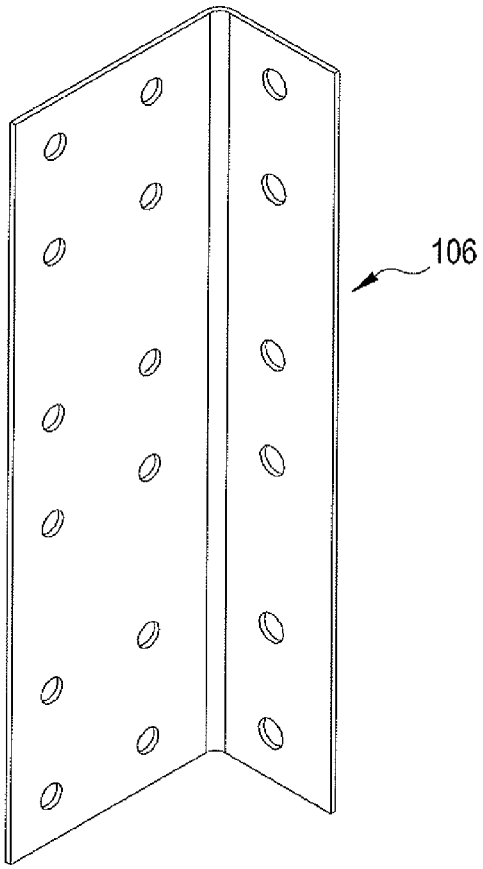
Figure 62:
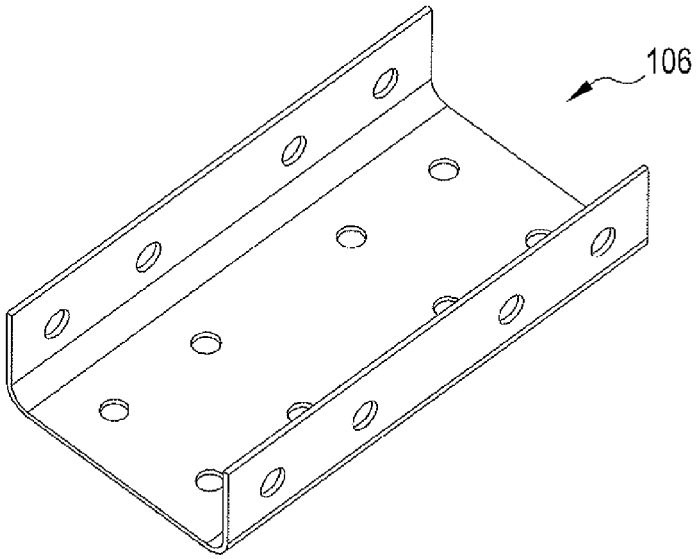
Figure 65:
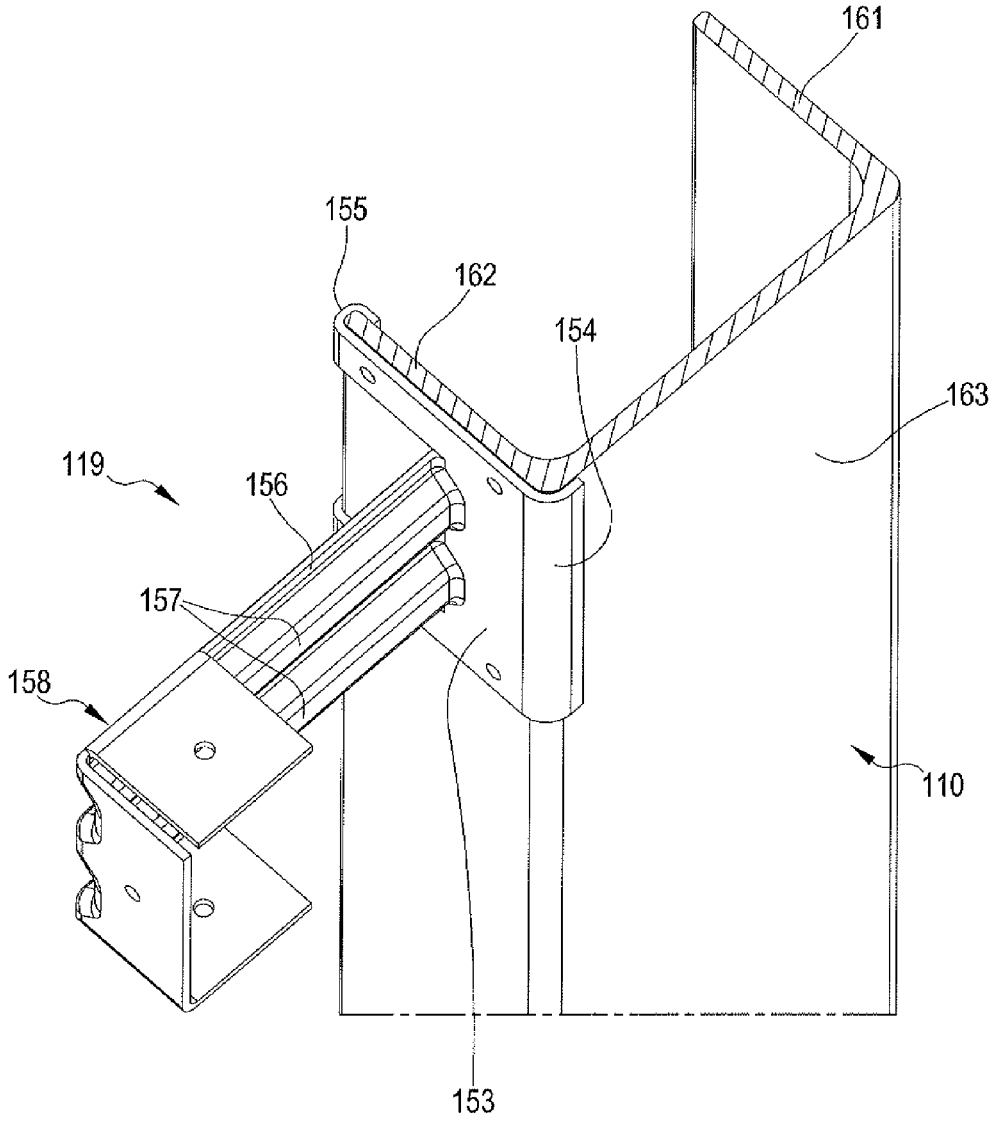

FIGS. from 4 to 11(*a*) are vertical section views showing, in sequence, installation operations of a wall structure according to the present invention;

FIGS. 11(*b*) and 11(*c*) are perspective and schematic views of a wall structure according to the present invention;

FIGS. 12 to 17 illustrate a transversal section of corresponding variants of a detail of the wall structure according to the present invention;

FIGS. 18 to 24 show vertical sections of the corresponding wall structures according to the present invention;

FIG. 25 is a vertical section of an embodiment of the wall structure according to the present invention;

FIG. 26 is a vertical section of an embodiment of the wall structure according to the invention;

FIG. 27 is a cross section of a component of the wall structure according to the present invention, subjected to a thermal gradient, in which the distribution of temperatures internally thereof is shown;

FIG. 28 is a schematic elevation view of a wall structure according to the present invention, in a first installing configuration;

FIG. 29 is a vertical section view of a detail of a wall structure according to the present invention, fixed to a floor;

FIG. 30 is a vertical section view of a constructive variant of the wall structure according to the present invention;

FIG. 31 is a is a schematic view in elevation of a wall structure according to the present invention, in a second installing configuration;

FIG. 32 is a lateral section view of a portion of the wall structure according to the present invention, in a third installing configuration;

FIGS. 33(*a*)-33(*d*) respectively show a first schematic section of a wall structure according to the present invention; a table of the relative dimensional characteristics; a table that summarizes the characteristics of the different layers of the wall structure and a time/temperature graph;

FIGS. 34 (*a*)-34 (*d*) respectively show a second schematic section of a wall structure according to the present invention, a table of the relative dimensional characteristics, a table summarizing the characteristics of the different layers of the wall structure and a time/temperature graph;

FIG. 35 is a lateral view of a building casing according to the present invention;

FIG. 36 is a transversal section of the building of FIG. 1;

FIG. 37 is a detail of the section of FIG. 36;

FIG. 38 is a detail of a transversal section relative to a building structure in accordance with the present invention;

FIG. 39 is a detail of a transversal section relative to a building structure in accordance with the present invention;

FIG. 40 is a perspective view of a building structure according to the present invention;

FIGS. 41 to 48 schematically show the lateral sections of the corresponding embodiments of the uprights in accordance with the present invention;

FIG. 49 is a section of a building structure in accordance with the present invention;

FIG. 50 is a section of an embodiment of the building structure according to the present invention;

FIG. 51 is a section of an embodiment of a building structure according to the invention;

FIG. 52 is a lateral section of a component of the building structure according to the present invention, subjected to a thermal gradient, in which the distribution of temperatures internally thereof is shown;

FIG. 53 is a section of a detail of a building structure according to the present invention;

FIG. 54 is a schematic view of a constructive variant of the building is structure according to the present invention;

FIGS. 55 and 56 are perspective views of a first embodiment of a connecting device in accordance with the present invention;

FIG. 57 is a perspective view of a second embodiment of a connecting device in accordance with the present invention;

FIG. 58 is an exploded view of a portion of a framework in accordance with the present invention;

FIGS. 59 and 60 are perspective views of a portion of framework in accordance with the present invention;

FIGS. 61 and 62 are perspective views of a connecting element of the framework in accordance with the present invention;

FIGS. 63 and 64 are perspective views of a stirrup of the framework in accordance with the present invention;

FIG. 65 is a perspective view of a stirrup engaged to an upright in accordance with the present invention.

DETAILED DESCRIPTION

Reference numeral 101 denotes in its entirety a support framework for building casings 200. The framework 101 of the present invention can be used for the construction of building casings 200 which will go to define the lateral surface of a building structure 300 or which can be used for the construction of building casings 200 which will go to clad the pre-existing perimeter walls of a building structure 300; the framework 101 object of the present invention is used in the construction industry for the production and/or cladding alone of dwellings and/or industrial buildings.

As visible for example in FIGS. 35 and 40, the framework 101 comprises a is plurality of uprights 110 each of which extends along a first prevalent development direction (each upright extends between a first and a second longitudinal end) and is intended in use to extend vertically between at least a first floor deck and/or base 102 and a second floor deck and/or base 102 of a building structure 300.

More in detail, each upright 110 exhibits a longitudinal extension that enables the upright to connect at least a first floor deck 102 to an immediately-consecutive second floor deck (i.e. to connect at least a first storey with an immediately consecutive storey of the building structure). However, it is possible to use uprights 110 which extend over a plurality of floor decks 102 and in particular along the entire height of the building structure 300.

As seen for example from FIG. 40, each upright 110 is advantageously arranged such that the prevalent development direction thereof is transversal, in particular perpendicular, to a floor deck and/or base 102: in a use condition of the framework 101, the direction of the prevalent development direction of each upright 110 is advantageously vertical.

As will be more fully described in the following, the uprights 110 are engaged to the building structure 300 by means of at least a constraining element 118 extending along a second prevalent development direction, transversal and in particular perpendicular to the first prevalent development direction of each upright 110: the constraining element 118 and uprights 110 define a net structure. The constraining element 118, which will be better described below, is configured on one side so as to stably constrain to a floor deck and/or base 102, and the other side to stably engage at least one of the uprights 110.

Each upright 110 includes a section bar where the first development direction is is straight: the section of the section bar is constant throughout the development of the upright 110. As can be seen for example in the detail of FIG. 37, each upright 110 includes at least a first and a second abutment 161, 162 connected together by a core 163: the first and second abutment are opposite and parallel to one another with respect to the core 163 which is perpendicular to the abutments 161, 162. The abutments 161, 162 and the core 163 comprise at least a plate a thickness of which is substantially smaller than the length and width of the plate. In particular, the first abutment 161 comprises a plate having a rectangular shape: the length of the plate of the abutment 161 is measured along the prevalent development direction of the upright 110 while the width and thickness are measured perpendicularly to the prevalent development direction of the upright 110. More in detail, the face of the plate having a greater extension (the face defined by the length and width of the plate) exhibits a flat surface 161*a* which defines a fixing portion 105 configured so as to be constrained to the floor deck and/or base 102 of the building structure 300. The flat surface 161*a* extends along all the longitudinal development of the upright 110.

The second abutment 162 also comprises a plate having a rectangular shape; the plate of the second abutment 162 is identical to the plate of the first abutment 161. The length of the plate of the second abutment is measured along the first prevalent development direction of the upright 110 while the width and thickness are measured perpendicularly to the first prevalent development direction of the upright 110. Also for the plate of the second abutment 162, the face having a greater extension is the one defined by the length and width of the plate; the face defines a flat surface 162*a* opposite the flat surface 161*a* of the is first abutment 161. The flat surfaces of the first and second abutments are parallel to one another. The contact surface 162*a* of the abutment 162 also extends over the entire longitudinal development of the upright 110.

The core 163 of the riser 110 connects between their abutments 161 and 162, the core 163 also comprises at least one plate having a rectangular shape, the length of the plate 163 of the core is measured along the prevalent development direction of the upright 110 while width and thickness are measured perpendicularly to the prevalent development direction of the upright 110. Also for the plate of the core, the face having a greater extension is the one defined by the length and width of the plate itself; the face defines at least a flat contact surface 163*a* which is perpendicular to the flat surfaces of the first and second abutment 161, 162. The contact surface 163*a* of the core 163 also extends over the entire longitudinal development of the upright 110.

The plate of the core 163 can be connected to the longitudinal ends of the abutments or be connected to a section between the ends, and in both cases the abutments and the core define, according to a cross section of the upright 110, a cavity 164 bounded by a substantially C-shaped profile a concavity of which is directed perpendicularly with respect to the flat surface 163*a* of the core: the cavity 164 is configured so as in use to extend laterally with respect to the floor deck 102.

In fact, each upright section 110 comprises a section bar formed essentially from the first abutment 161, the second abutment 162 and the core 163. The section bar has a constant cross-section along the whole development of the upright 110; as can be seen in FIGS. 41 to 48, the cross section of the upright 110 can have different profiles, for example "C" (FIG. 47), "T", or "H" (FIGS. 41-46, 48). As shown in the accompanying figures, the upright 110 can comprise a core 163 constituted by one or more plates, spaced apart from one another; in the configuration with a plurality of plates, the upright 110 comprises one or more housing compartments A-D having a substantially closed profile.

The uprights 110 may be solid or hollow; however, the uprights 110 are preferably hollow to minimize the weight, production costs, and to be able to house parts of installations internally thereof. In the examples shown in figures from 41 to 48, the uprights 110 are hollow and define one or more housing compartments A-D. Cables and/or tubes, for example, can be housed internally of the compartments. Further, each housing compartment present on the upright 110 can be used in several ways; for example compartment A can be used for housing electrical wires while the cavity B can be used to house tubes of the air conditioning plant.

In terms of size, each upright 110 exhibits a length measured along the first prevalent development direction thereof, greater than 2000 mm, in particular between 2500 and 7000 mm, still more in particular between 2500 and 4000 mm, preferably 3200 mm. The upright 110 also has a width, measured transversally to the first direction of the prevalent development direction of the upright 110, substantially defined by a width of the first and/or second abutment 161, 162, which is equal to or greater than 50 mm, in particular between 50 and 250 mm, still more in particular between 50 and 200 mm. The upright 110 has a thickness, measured transversally to the first prevalent development direction of the upright 110 and defined by the maximum distance between the first and the second abutment 161, 162: the thickness is equal to or greater than 100 mm, in particular comprised between 100 and 300 mm, still more in particular between 150 and 250 mm.

In terms of materials, each upright 110 is made of heat-insulating material; in particular it comprises a polymer resin and reinforcing fibres embedded in the resin; the polymer resin comprises at least a thermosetting resin and/or a thermoplastic resin; in particular the polymer resin includes at least one selected from the group of the following materials: polyester, epoxy resin, acrylic resin, vinyl ester, phenolic resin, PVC, polyurethane, polyethylene. The reinforcing fibres instead comprise at least one selected from the group of the following materials: glass fibre, carbon fibre, synthetic fibre, basalt fibre.

The reinforcing fibres are advantageously present internally of the resin in a percentage in weight of higher than 40%, in particular in a weight percentage between 40% and 90%, preferably about 70%.

Each upright 110 is advantageously obtained by a pultrusion process so as to define an upright 110 with a pultruded section bar. Materials and the process of realising the upright 110 enable defining an element having mechanical characteristics comparable with the corresponding metal profiles made of steel or aluminum, or PVC. This makes the pultruded section bars suitable to be used as uprights of wall structures. Apart from the excellent mechanical properties thereof, pultruded section bars are also excellent heat and electrical insulators, and have good ability to damp acoustic vibrations. Table 1 below summarises the main mechanical characteristics of a pultruded section bar of the type described above, suitable to be used as an upright.

TABLE 1

| Property | Pultruded | Steel | Aluminium | PVC | Unit |
|---|---|---|---|---|---|
| Density | 1.8 | 7.8 | 2.8 | 1.4 | $g/cm^3$ |
| Resistance to traction | 350-400 | 370-500 | 200-400 | 40-60 | MPa |
| stretching under traction | 1.5-2.0 | 13-35 | 5-35 | 10-80 | % |
| Resistance to flexion | 400-450 | 330-500 | 200-400 | 70-100 | MPa |
| Elasticity Modulus | 25-30 | 210 | 70 | 2.8-3.3 | MPa × $10^3$ |
| Flexion strength | 15-20 | 210 | 70 | 2.8-3.3 | MPa × $10^3$ |
| Impact resistance | 200 | 400 | 200 | 85-95 | $MPa/m^2$ |
| Heat conductivity | 0.25-0.35 | 100-230 | 100-230 | 0.15-0.25 | W/m ° C. |
| Coefficient of expansion | 5-20 × $10^6$ | 10-14 × $10^6$ | 20-25 × $10^6$ | 50-100 × $10^6$ | M/m ° C. |
| Dielectric capacity | 5-15 | — | — | 40-50 | KV/mm |
| Volume resistivity | 1010-1014 | 0.2-0.8 | 0.028 | >1016 | ωcm |

With respect to a section bar made of steel or aluminium, given an equal section, the pultruded member is lighter while having excellent mechanical characteristics.

The pultruded section bars that constitute the uprights 10 advantageously deaden sounds because of the insulating nature of the materials they are made of. Therefore any noises conveyed by discharge pipes housed in the uprights 110 are not transmitted by them to other elements of the building structure. Further, due to the nature of the uprights 110 the uprights 110 are not sensitive to damp, so any condensation or loss of water in the plants passing internally (in proximity) of the upright 110 do not compromise the mechanical characteristics thereof.

As can be seen in FIGS. 35 and 40, the framework 101 comprises at least a series 147 of uprights 110 flanked to one another and substantially parallel to one another; the series 147 can comprise a number of uprights 110 of greater than 2, in particular comprised between 2 and 20, still more in particular comprised between 2 and 10. In fact the series 147 exhibits a number of uprights 110, for each 10 linear metres measured along a perpendicular direction to the prevalent development direction of each upright, of greater than 2, in particular comprised between 3 and 20.

In particular, the uprights 110 of the series 147 have a minimum distance to each other of equal to or greater than 0.4 m, in particular between 1 and 5 m. All the uprights of the 110 series 147 are advantageously substantially equidistant from each other: in this way a structurally uniform framework 101 is created. As previously described, the uprights 110 are connected to the building structure by means of constraining elements 118, in more detail, the uprights 110 of the is series are connected to on another by means of a single constraining element 118: the constraining element 118 connecting the plurality of uprights of the series 147 and being configured to constrain the uprights to at least a floor deck 102 (with a single fixing element 118 is possible to stably fix a plurality of uprights 110 to the floor deck 102).

As described above, each upright member 110 extends at least between a floor deck 102 and another immediately consecutive; in an embodiment of the framework 101, as illustrated for example in FIG. 38, the framework 101 comprises at least two uprights 110 aligned substantially along a single prevalent development direction so as to define a lower upright 110*a* and an upper upright 110*b* consecutive to one another; facing ends of the uprights 110*a*, 110*b* are arranged at a same floor deck 102 of a building structure 300. In this condition, the lower upright 110*a* is configured so as to be fixed to a lower surface 102*a* of the floor deck 102 while the upper upright 110*b* is configured to be fixed to an upper surface 102 of the floor deck 102. In this condition it is possible to provide a first constraining element 118 engaged to the lower upright 110*a* and configured to connect to the lower surface 102*a* of the floor deck 102; it is also possible to include a second constraining element 118 engaged to the upper upright 110*b* and configured so as to connect to the upper surface 102*b* of the same floor deck 102.

In the configuration described above, illustrated in detail in FIG. 38, the lower and upper upright 110*a*, 110*b* are axially abutting: the facing ends of the lower and upper upright 110*a*, 110*b* are at least partially in contact. Despite the fact that the lower and upper upright 110*a*, 110*b* are fixed to the floor deck 102 by means of the constraining element 118, the framework 101 might include at is least a connecting element 106 (FIGS. 61 and 62) which axially constrains the lower upright 110*a* to the upper upright 110*b*.

The connecting element 106 essentially comprises a first engaging portion 106*a* constrained to the fixing portion 105 of the lower upright 110*a* and a second engaging portion 106*b* constrained to the fixing portion 105 of the upper upright 110*a*: in this way the two uprights are axially aligned. Structurally, the connecting element 106 comprises a plate at least partially complementarily shaped to the cavity 164 of the uprights 110 (both lower and upper uprights): the connecting element 106 is housed inside the cavity 164 and has, in transversal section, surfaces in contact with the core 163 and abutments 161, 162 of the upright 110. In greater detail, the connecting element 106 is a section bar having a constant cross section made of a metal material, in particular steel or aluminum.

To give greater rigidity to the structure, the connecting element 106 can be engaged to the first and second fixing element 118; in particular, the first constraining portion 106*a* of the connecting element 106 is stably connected to the first constraining element 118 in such a way that the fixing portion 105 of the lower upright 110*a* is interposed between the first constraining portion 106*a* of the connecting element 106 and the first constraining element 118. In the same way the second constraining portion 106*b* of the connecting element 106 is stably connected to the second constraining element 118 so that the fixing portion 105 of the upper upright 110*b* is interposed between the second retaining portion 106*b* of the connecting element 106 and the second constraining element 118 (FIG. 38).

As previously mentioned, the constraining element 118 extends along a second is prevalent development direction transversal to the first prevalent development direction of the uprights 110; the constraining element 118 has at least the first engagement portion 128 configured such as to be stably constrained to a floor deck and/or base 102 of a building structure 300 and a second engagement portion 129 stably anchored to a plurality of uprights, and in particular to all the uprights of the series 147. Advantageously, the constraining element 118 is configured so as to extend along at least a whole side of the floor deck and/or base 102.

In greater detail, the first engaging portion 128 of the constraining element 118 comprises a flat support surface 128*a* able to abut an upper surface and/or bottom of the floor deck and/or base 102; the second engaging portion 129 of the securing element 118 comprises a respective flat rest surface 129*a* able to abut the contact surface 161*a* of the first abutment 161 and in particular able to engage the fixing portion 105 of the uprights 110. The first and the second engagement portion 128, 129 are arranged transversally relative to one another and are joined in a piece to form a single solid body; in particular, the first and the second support surface 128*a*, 129*a* are perpendicular to one another and facing on opposite sides of the securing element 118. In fact, the first and second engagement portion 128, 129 of the securing element 118 define a section bar having, in a transversal section view, substantially an L-shape: the section bar extending transversally to the uprights and being directly engaged in a plurality thereof.

In still greater detail, the first engaging portion 128 of the constraining element 118 comprises a first plate having a thickness substantially smaller than a length thereof, measured along the second prevalent development direction of the is securing element 118, and a width, measured perpendicularly to the second prevalent development direction of the constraining element 118. The plate of the first engaging portion has a rectangular shape; the face exhibiting the greater extension is directed toward the floor deck 102.

In terms of size, the first plate of the first constraining portion 118 has a length, measured along the second prevalent development direction of the constraining element 118, of equal to or greater than 1 m, in particular between 1 and 15 m, still more in particular between 3 and 10 m. The width of the first plate, measured perpendicularly with respect to the second direction of the prevalent development direction, is equal to or greater than 75 mm, in particular between 100 and 250 mm. The minimum thickness of the first plate is equal to or greater than 1.5 mm, in particular between 2 and 5 mm.

The dimensions of the first plate of the first engaging portion 128 can also be defined using the ratio between length, width and thickness. In particular, the ratio between the length and the width of the first plate of the first engagement portion 128 is greater than 7, in particular greater than 10, still more in particular greater than 20. The ratio between the length and the thickness of the first plate of the securing element 118 is greater than 400, in particular greater than 1000, still more in particular greater than 2000. The ratio between the width and the thickness of the first plate of the first engagement portion 128 is greater than 20, in particular greater than 30, still more in particular greater than 50.

In the same way, the second engaging portion 129 of the constraining element 118 comprises a second plate exhibiting a thickness that is considerably smaller than a length, measured along the second prevalent development direction of the is constraining element 118, and a width, measured perpendicularly to the second prevalent development direction of the constraining element 118. The plate of the second engaging portion 129 also exhibits a rectangular shape; the face exhibiting the greatest extension is facing towards the contact surface 161*a* of the first abutment.

In terms of dimensions, the second plate of the second engaging portion 129 exhibits a length, measured along the second prevalent development direction of the constraining element 118, equal to or greater than 1 m, in particular comprised between 1 and 15 m, still more in particular comprised between 3 and 10 m. The width of the second plate, measured perpendicularly with respect to the second prevalent development direction of the constraining element 118, is equal to or greater than 75 mm, in particular comprised between 100 and 250 mm. The minimum thickness of the second plate is equal to or greater than 1.5 mm, in particular comprised between 2 and 5 mm.

It is further possible to define the dimensions of the second plate of the second engaging portion 129 by means of the ratio between length, width and thickness. In particular, the ratio between the length and width of the second plate of the second engaging portion 129 is greater than 7, in particular greater than 10, still more in particular greater than 20. The ratio between the length and the width of the second plate of the constraining element 118 is greater than 400, in particular greater than 1000, still more in particular greater than 2000. The ratio between the width and the thickness of the second plate of the constraining element 118 is greater than 20, in particular greater than 30, still more in particular greater than 50.

In fact, the first and the second plate respective of the first and second engaging is element 128, 129, are identical to one another (identical both in shape and dimensions).

In greater detail, the constraining element 118 comprises a section bar the prevalent development direction of which (second prevalent development direction of the constraining element 118) is straight and the transversal section whereof is constant over the whole development of the constraining element 118. As regards materials, the constraining element 118 is realized at least partly of a metal material, in particular is entirely made of steel or aluminium.

As can be seen for example in FIG. 39, the constraining element 118 can further comprise a closure portion 148 emerging from the second engaging portion 129 on the same side on which the first engaging portion 128 is arranged, to define a section bar having a substantially C-shaped section, with the concavity facing on the opposite side with respect to the upright 110; the section bar defined by the constraining element 118 and by the closure portion 148 constitutes a conduit 149 configured so as to passingly accommodate tubes, cables and/or to define a fluid passage, for example for air ventilation. The closure portion 148 advantageously extends over the whole length of the constraining element 118, in particular the conduit 149 is configured so as to extend along a whole side of the floor deck and/or base 102. In this configuration it is possible to have a conduit for the passage of tubes, cables extending along an edge of the floor deck 102 and thus over at least a section of a lateral surface of the building structure 300.

FIG. 39 shows a preferred embodiment of the invention, in which there is at least a closure portion 148 for each of the first and second constraining element 118 (elements arranged respectively at the lower surface 102*a* and the upper is surface 102*b* of the floor); in this configuration it is possible to define a conduit 149 for the passage of tubes, cables and/or to define ventilation conduits at both sides of the floor deck 102: a conduit 149 is thus positioned at the upper plane on the floor while a further conduit is positioned at the lower plate, at the floor (FIG. 39).

The conduit 149 advantageously exhibits a passage (not illustrated in the figures) able to place in fluid communication at least the internal cavity of the conduit with at least a cavity 164 of an upright 110: tubes and/or cables of the building structure 300 can slide internally of the cavity 164 of an upright 110 then to enter the conduit 149 by virtue of the passage. The conduit 149 therefore enables easily enabling connection of hydraulic plant, electrical plant and/or ventilation at any point of the floor deck and/or base 102.

Still observing FIG. 39, 102' denotes a layer formed by the screed and tiles. As can be observed, the upper conduit 149 arranged at the screed 102' is closed by a removable cover 125' which also functions as a skirting board. Likewise the lower conduit 149 arranged at a false floor 102" is closed by a respective removable cover 126'. It is clear that the above-described configuration is particularly advantageous for installation of plant. The uprights 110 together with the conduits 149 form, in the building structure 300, a network of channels in which, for example, the following can be inserted and positioned: tubes, wires, sheaths, or all the components required in an electrical plant, a hydraulic plant and an air-conditioning plant (civil and/or industrial).

When for example inserting a wire-guide tube, or discharge tubes, the installers can simply convey these elements internally of the conduits 149 and is subsequently inside the uprights 110 (the installers therefore do not have to break the building structure 300 in order to predispose the various plants). Then, in order to reach a tube or electric cable present internally of the conduit 149, it is sufficient to remove the cover 125', 126' in order to gain access to the conduit.

As can for example be seen in FIG. 54, the framework 101 can further comprise at least a projecting element 138, extending along a respective prevalent development direction transversal to the prevalent development direction of the upright 110: the projecting element 138 is engaged, substantially by a first end **138*a* to an upright 110 so as to be able to emerge from the upright 110 and receive projecting loads with respect to the upright 110. The projecting element 138 thus emerges from the upright 110 on the opposite side to the constraining element 118, in particular it is able to emerge from the opposite side of the floor deck 102. The framework 101 further comprises a connecting device 133 which engages the first end 138*a* of the projecting element 138 with the upright 110. The projecting element 138 and the connecting device 133 are configured so as to define a support structure, constrained stably to the upright 110**, able to support projecting loads: for example the support structure can be used for realizing balconies.

As can be seen for example in figures from 55 to 57, the connecting device 13 comprises at least a first connecting portion 139 engaged to the core 162 of the upright 110, at least a second connection portion 140 engaged to the second abutment 162 of the upright 110 and at least a third connecting section 141 engaged to the projecting element 138.

In greater detail, the first connecting portion 139 of the connecting device 133 is extends along a prevalent development direction parallel to the contact surface **163*a* of the core of the upright 110. The first connecting portion 139 comprises at least a plate exhibiting a thickness that is considerably smaller than the length and the width of the plate: the plate of the first connecting portion 139 is parallel to the plate of the core 163**.

FIGS. 55 and 56 illustrate a first embodiment of the connecting element 133 comprising two identical plates spaced and parallel with respect to one another, interconnected by the third connecting portion 141. Each of the plates extends along a prevalent development direction between a first and a second longitudinal end: each plate is connected to the third connecting portion at the first longitudinal end (same end); in this configuration the two plates of the first connecting element 139 exhibit a symmetry with respect to the third connection portion 141. In a view from above the connecting device 133 (observing the device along a perpendicular direction to the prevalent development direction of the first connecting portion 139), the third connecting portion and the plates of the first connecting portion 139 define a C-shaped element. In the engaged condition of the connecting portion 133 with the upright, the concavity of the C-shaped element defined by the first and third connecting portion 139, 141 is facing towards the constraining element 118 (it is configured so as to be facing towards the floor deck 102).

In the embodiment illustrated in FIG. 57, the first connecting portion 139 comprises a single plate connected to the second and the third connecting portion 140, 141. The plate illustrated in FIG. 57 exhibits a rectangular shape. In terms of dimensions, the plate of the first connecting portion 139 exhibits a length, measured perpendicularly to the first prevalent development direction of is the upright 110, equal to or greater than 100 mm, in particular comprised between 100 and 250 mm. In greater detail, the length of the plate of the first connecting portion 139 is substantially identical to or greater than the width of the core 163 and/or greater than the distance between the first and the second abutment 161, 162.

The plate of the first connecting portion 139 exhibits a width, measured parallel to the first prevalent development direction of the upright 110, equal to or greater than 15 mm, in particular comprised between 15 and 50 mm, still more in particular comprised between 20 and 40 mm. The plate of the first connecting portion 139 exhibits a thickness that is equal to or greater than 1.5 mm, in particular comprised between 2 and 5 mm.

As previously described, the second connecting portion 140 of the connecting device 133 extends along a prevalent development plane parallel to the contact surface **162*a* of the second abutment 162 of the upright 110 in such a way as to act abuttingly against the second abutment 162. The second connecting portion 140 also comprises at least a rectangular plate exhibiting a thickness that is considerably smaller than the length and width of the plate: the plate of the second connecting portion 140 developing parallel to the plate of the second abutment 162**.

In fact, the second connecting portion 140 defines, with respect to the first connecting portion 139, a projection 137 emerging perpendicularly from the development plane of the first connection portion 139. In the configuration of the connecting device 133 illustrated in FIGS. 55 and 56, the plate of the second connecting portion 140 extends between the two spaced plates of the first connecting portion 139.

As regards the dimensional profile, the plate of the second connecting portion 140 exhibits a length, measured parallel to the first prevalent development direction of the upright 110, that is equal to or greater than 50 mm, in particular comprised between 100 and 250 mm. in the configuration of the connecting device 133 illustrated in FIGS. 55 and 56, the length of the plate of the second connecting portion 140 coincides with the minimum distance between the plates of the first connecting portion 139.

The plate of the second connecting portion 140 further exhibits a width, measured perpendicularly to the first prevalent development direction of the upright 110, equal to or greater than 15 mm, in particular comprised between 15 and 50 mm, still more in particular comprised between 20 and 40 mm. The plate of the second connecting portion 140 exhibits a thickness that is equal to or greater than 1.5 mm, particular comprised between 2 and 5 mm.

In a preferred embodiment, but not limiting, the thickness of the first connecting portion 139 is equal to the thickness of the second portion 140.

In relation to the third connecting portion 141, it comprises at least a plate exhibiting a thickness that is considerable smaller than the length and width of the plate; the plate exhibits a rectangular shape, in particular square and extending along a prevalent development plane that is parallel to the first connecting portion 139. In the embodiment realized in FIGS. 55 and 56, the plates respectively of the first and the third connecting portion 139, 141 are parallel and spaced from one another; the distance, measured between the plates, is equal to or greater than 1 mm, in particular comprised between 1 and 5 mm. In fact, the plate of the first connecting portion 139 and the plate of the third connecting portion 141 define, on a same side of the connecting device, is respective contact surfaces that lie on offset planes.

Alternatively the plates of the first and third connecting portion 139, 141 are arranged on a same prevalent development plane (FIG. 57). As visible for example in FIG. 59, the plate of the third connecting portion 141 is arranged precisely following the core 163 of the upright 110.

The plate of the third connecting portion 141 exhibits a length, measured perpendicularly to the first prevalent development direction of the upright 110, equal to or greater than 50 mm, in particular comprised between 100 and 250 mm. The plate of the third connecting portion 141 exhibits a width, measured parallel to the first prevalent development direction as the upright 110, equal to or greater than 50 mm, particular comprised between 50 and 250 mm. The plate of the third connecting portion 141 exhibits a thickness that is equal to or greater than 1.5 mm, in particular comprised between 2 and 5 mm. In a preferred embodiment, though not limiting, of the invention, the thickness of the third connecting portion 141 is equal to the thickness of the first and the third connecting portion 139, 140.

In an embodiment of the invention, the first, second and third connecting portion 139, 140, 141 of the connecting device 133 are joined in a piece to form a single solid body. In this condition, the first and the third connecting portions define a plate-shaped main body 136 from which the projection 137 defined by the second portion 140 emerges perpendicularly.

Each portion 139, 140 and 141 comprises a series of holes; the framework 101 comprises coupling means (not illustrated in the figures) cooperating with the holes of the connecting device 133 and configured so as to enable fixing the device 133 both to the upright 110 and the projecting element 138. In fact, the is coupling means comprise mechanical blocking systems, for example bolt-nut systems and/or rivets. Obviously both the projecting element 138 and the upright comprise a respective series of holes which are configured so as to receive the mechanical fixing systems.

Turning now to the projecting element 138, it comprises a section bar extending along a prevalent development direction; the section bar exhibits a C-shaped transversal section having a concavity thereof facing on an opposite side with respect to the cavity 164 of the upright 110. The section bar exhibits, in a transversal section, a profile that is constant along a whole longitudinal development thereof.

The projecting member 138, at the first end thereof, comprises a contact surface 144 extending along a prevalent development plane parallel to the contact surface 163*a* of the core 163 of the upright 110. The contact surface 144 is able to abut the core 163: the contact surface exhibits the series of holes which enable fixing the projecting member on the upright 110.

In dimensional terms, the projecting member 138 exhibits a length, defined by the distance between the longitudinal elements of the element 138, comprised between 500 and 3000 mm, in particular between 1000 and 2500 mm (the length is measured perpendicularly with respect to the first prevalent development direction of the upright). The width of the projecting element, measured along a parallel direction to the first prevalent development direction of the upright 110, is greater than 50 mm, in particular is comprised between 100 and 250 mm. The thickness of the section bar of the projecting element 138 is substantially identical to the thickness of the upright 110, in particular the thickness is greater is than 1.5 mm, and in particular is comprised between 2 and 5 mm.

The projecting element is also made of a metal, for example steel or aluminium; in particular the projecting element 138 is made of the same material with which the connecting device 133 is realised: in this way, as well as connecting the connecting device 133 with the projecting member 138 using screws and/or rivets, welding seams can be included, for fixing the elements further.

As is visible for example in FIG. 59, the framework can further comprise at least a support element 146 engaged to at least an upright 110 on an opposite side with respect to the connecting device 133; the support element 146 is at least in part complementarily shaped to the core 163 and the second abutment of the upright 110 so that the upright 110 is interposed between the connecting device 133 and the support element 146.

In greater detail, the support element 146 comprises a first engaging portion 146*a* constrained to the core 163 of the upright; the support element 146 comprises a second engaging portion 146*b* constrained to the second abutment 162 of the upright 110. The first engaging portion 146*a* is stably connected to the core 163 and to the projecting element 138 in such a way that the core 163 is interposed between the first engaging portion 146*a* and the first connecting portion 139 of the connecting device 133; the second engaging portion 146*b* of the support element 146 is stably connected to the second abutment 162 of the upright 110 in such a way that the second abutment 162 is interposed between the second connecting portion 140 of the connecting device 133 and the second engaging portion 146*b* of the support element 146.

In greater detail, it can be seen how the support element 146 comprises a plate at is least partly complementarily shaped to the cavity 164 of the upright 110: the support element 146 is housed in the cavity 164 and exhibits, in transversal section, surfaces in contact with the core 163 and the abutments 161, 162 of the upright 110. In still greater detail, the support element is a section bar having an L- or a C-section, extending parallel to the prevalent development direction of the upright 110. The support element 146 is also made of a metal material, in particular steel or aluminium.

As visible in the figures, the framework 101 further comprises a plurality of stirrups 119, each of which is engaged to an engaging portion 152 of the upright 110; each stirrup 119 is arranged transversally with respect to the upright to which it is associated and is configured to emerge therefrom. Each stirrup 119 comprises at least a constraining portion 151 configured so as to cooperate with the engaging portion 152 of the upright and to define a snap-fit engagement there-with: the engaging portion 152 is substantially defined by the at least a portion of the second abutment and/or the core 153 of the upright 110. The engaging portion 152 is arranged on the same side as the fixing portion 105 and/or on a side of the upright opposite the fixing portion 105. The engaging portion 152 extends along the whole development thereof, in particular along the section defined between two fixing portions immediately consecutive of one another: the stirrup 119 is configured so as to engage on the upright 110 in a plurality of operative positions axially offset to one another.

The framework 101 comprises a plurality of stirrups 119 engaged on a single upright 110 which bears at least a number of stirrups 119 equal to or greater than 2, in particular greater than or equal to 3, still more in particular comprised between 3 and 20. In fact, the framework 101 comprises at least a first series of stirrups 119 engaged on a single upright 110 (FIG. 38) and configured so as to emerge therefrom on an opposite side to the fixing portion 105: the first series of stirrups 119 comprises a number of stirrups equal to or greater than 2, in particular comprised between 2 and 10. The stirrups 119 of the first series are advantageously equidistant from one another along the upright 110 and comprise a number of stirrups, per two linear metres of upright 100, of greater than 2, in particular comprised between 3 and 5. In fact, a stirrup 119 of the first series exhibits an axial distance from a stirrup 119 immediately consecutive of greater than 20 cm, in particular comprised between 30 and 150 cm. In a preferred embodiment, but not limiting, of the framework 101, the framework further comprises a second series of stirrups 119 engaged on a single upright 110 on the opposite side to the first series of stirrups 119: the second series comprising a further number of stirrups 119 that is equal to or greater than 2, in particular comprised between 2 and 10. The second series of stirrups 119 exhibits the same characteristics as the above-described first series.

Looking more closely at the structure of each stirrup 119, it can be observed that it comprises at least a constraining portion 151 comprising a base 153 exhibiting at least a plate extending along a prevalent development plane; the constraining portion 151 comprises a first and a second lip 154, 155 spaced from one another and emerging from opposite sides of the base 153 on a same side of the base. The first lip 154 exhibits, in a transversal section, a straight profile destined to abut against an edge of at least an abutment 161, 162, while the second lip 155 exhibits, according to a transversal section, an arched and curved profile in the direction of the first lip 154 destined to envelop an edge of at least an abutment. In fact, one of the first and second lip 154, 155 exhibits a portion directed nearingly with respect to the other of the first and second lip 154, 155; in this way the first and/or the second lip 154, 155 define, with respect to the base, at least an undercut.

The first lip 154 emerges perpendicularly with respect to the development plane of the base 153, by an amount comprised between 1 and 10 mm, in particular comprised between 2 and 5 mm; the second lip 155 emerges perpendicularly with respect to the development plane of the base 153, by an amount comprised between 1 and 10 mm, in particular comprised between 2 and 5 mm. The two lips 154 and 155 of the stirrup emerge from the base 153 by an identical amount. The base 153 comprises a flat plane developing along a prevalent development direction, in particular parallel to the first prevalent development direction of the upright 110; the base 153 exhibits a predetermined length, measured along the prevalent development direction of the base 153, of greater than 50 mm, in particular comprised between 50 and 200 mm. The base 153 exhibits a predetermined width, measured perpendicularly to the prevalent development direction of the base 153, of greater than 30 mm, in particular comprised between 50 and 250 mm. The base 153 exhibits a predetermined thickness of greater than 1.5 mm, in particular comprised between 2 and 5 mm. The first and/or second lip 154, 155 emerges from the base 253 over all the longitudinal extension thereof. In a preferred though non-limiting configuration, the first lip 154 extends over a whole length of the base while the first lip extends only over two longitudinal sections of the base distanced from one another at longitudinal ends of the base 153.

The stirrup 119 further comprises a spacer 156 emerging from the base 153 on the opposite side with respect to the first and second lip 154, 155; the spacer 156 is extends along a prevalent development direction between a first and a second longitudinal end 156*a*, 156*b*: the first end 156*a* is arranged at the base 153 while the second end 156*b* is distanced from the base 153. As is visible, the development direction of the spacer 56 is perpendicular to the prevalent development plane of the base 153. The minimum distance between the second end 156*b* of the spacer 156 and the base 153, measured perpendicularly with respect to the prevalent development plane of the base 153, is greater than 50 mm, in particular is comprised between 50 and 250 mm, preferably being about 150 mm. The spacer 156 further exhibits a width, measured parallel to the prevalent development direction of the base 153, that is equal to or greater than 30 mm, in particular is comprised between 30 and 100 mm. The thickness of the plate is equal to or greater than 1.5 mm, in particular it exhibits a thickness comprised between 1.5 and 5 mm. In particular, the thickness of the spacer is equal to the thickness of the base 153. The spacer 156 advantageously comprises a flat or undulated plate; in fact, as can be seen for example by FIGS. 63, 64, the spacer 156 comprises at least an undulated portion 157 extending between the first and the second end 156*a*, 156*b* of the spacer 156.

As can be seen the stirrup 119 further comprises a fixing element 158 engaged to the spacer 156 substantially at the second end 156*b*. The fixing element 158 is configured so as to engage and/or support one or more layer of the building casing 200, for example engage closure panels of the casing and/or insulating layers. The building casing 200 will be more fully described in the following.

As can be seen from the example of FIG. 63, the fixing element 158 comprises at least a first fixing portion 158*a* comprising at least a flat rectangular plate emerging transversally, in particular perpendicularly, from the spacer 156: the is plate of the fixing portion 158*a* is perpendicular to the base 153. In greater detail, the first fixing portion 158*a* of the stirrup, according to a use condition of the framework 101, extends along a substantially horizontal development plane. The thickness of the plate of the first fixing portion 158*a* is equal to or greater than 1.5 mm, in particular is comprised between 1.5 and 5 mm. The thickness of plate of the first fixing portion 58*a* is advantageously equal to the thickness of the base 153 and/or the spacer 156.

The fixing element 158 further comprises at least a second fixing portion 158*b* comprising at least a flat rectangular plate emerging transversally, in particular perpendicularly, from the spacer 156: the plate of the second fixing portion 158*b* is parallel to the base 153. In fact, the second fixing portion 158*b* of the stirrup, in a use condition of the framework 101, extends along a substantially vertical development plane.

The thickness of the plate of the second fixing portion 158*b* is equal to or greater than 1.5 mm, in particular it is comprised between 1.5 and 5 mm. The thickness of the plate is advantageously equal to the thickness of the base 153 and/or of the spacer 156.

The fixing element 158 comprises at least a third fixing portion 158*c* comprising at least a flat rectangular plate emerging transversally, in particular perpendicularly, from the spacer 156: the plate of the third fixing portion 158*c* is substantially perpendicular to the base 153. In terms of dimensions, the thickness of the plate of the third fixing portion 158*c* is equal to or greater than 1.5 mm, in particular is comprised between 1.5 and 5 mm. The thickness is advantageously equal to the thickness of the base 153 and/or the spacer 156. In fact, the first and the third fixing portion 158*a*, 158*c* of the stirrup 119 are is identical in both shape and dimensions. Further, the first and the third fixing portion 158*a*, 158*c* of the stirrup 119 are symmetrically arranged on the opposite edges of the spacer 156.

The base 153, the spacer 156 and the fixing element 158 are advantageously joined in a piece so as to define a single solid body. As regards the materials, the stirrup 119 is realized at least partly of metal, in particular it is made of aluminium or steel.

Building Casing

A further object of the present invention is a building casing 200 comprising the framework 101 described above; the constraining element 118 of the framework 101 is configured so as to be stably constrained to a floor deck and/or base 102 of the building structure 300; the building casing 200 is thus engaged to the building structure by means of one or more of the constraining elements 228. The building casing 200 comprises at least an internal cladding 108 engaged to the framework 101 on the same side where the constraining element 118 is arranged: the internal cladding element 108 is able to cover at least a part of the framework 101 extending between a first floor deck and/or base 102 and a second floor deck and/or base 102.

As is visible for example in FIG. 37, the building casing 200 further comprises an external cladding 109, engaged to the framework 101 on the opposite side with respect to the internal cladding 108; the external cladding 109 entirely covering the framework 101 and being configured so as to define a lateral external surface of the building structure 300: the internal and external cladding 108, 109 delimiting a gap 132 internally of which the framework 101 is arranged. The internal and external cladding 108, 109 can be directly constrained to the uprights 110 of the framework 101 (FIG. 49) or can be stably constrained in a distanced position with respect thereto.

The internal cladding 108 comprises a predetermined number of closure panels 111 defining the internal surface of the building casing 200 while the external cladding 109 comprises a predetermined number of closure panels 112 defining the external surface of the building casing 200. In greater detail, the closure panels 111 and 112 comprise plasterboard panels: the panels will later be smoothed and painted so as to define the exposed surfaces 103, 104 internal and external of the building structure. If the wall defined by the building casing 200 is a perimeter wall, the panels 112 define an external surface 104 facing towards the outside, and therefore exposed to the atmospheric agents. In this circumstance the internal closure panels 111 define an internal surface 103. If the wall defined by the building casing 200 is a partition wall, the surfaces 103 and 104 face towards an ambient of the building, for example a room.

If the closure panels 111 and 112 of the building casing 200 are constrained in a distanced position from the upright 110 it is possible to use the stirrups 119; in particular the panels are fixed to the second fixing portion 158*b* of the stirrup 119 in such a way that the panels are distanced from the upright 110. Alternatively the panels can be fixed to respective anchors 120 borne stably by the stirrup 119: the anchors 120 represent further spacers able to distance the closure panels 111 and 112 from the stirrups 119 and therefore to further distance the panels from the uprights 110.

In greater detail, a predetermined number of stirrups 119 can be interposed between the uprights 110 and the closure panels 111 of the internal cladding 108; the stirrups 119 are engaged to a side of the upright 110 and on the other side by engaging one or more closure panels 111 of the internal cladding 108 so as to define, internally of the gap 132, a first chamber 159 which is able to contain one or more layers of heat and/or acoustically insulating material 113-117, 121, 122, 127. It is equally possible to include a predetermined number of stirrups 119 interposed between the upright 110 and the closure panels 112 of the external cladding 109; the stirrups 119 are engaged on a side to the upright 110 and on the other side they engage one or more closure panels 112 of the external cladding 109 so as to define a second chamber 160 which is able to contain one or more layers of heat and/or acoustically insulating material 113-117, 121, 122, 127. The maximum distance between the panels 111 and 112 defines the width of the building casing 200 which is comprised between 200 and 500 mm, in particular between 200 and 400 mm.

As can be seen in FIG. 37, a volume of the gap 132 not occupied by the framework 101 and interposed between the closure panels is filled, entirely or in part, with one or more layers of heat and/or acoustically insulating material 113-117 or insulating and/or filler material 121-122, 127; each of the insulating layers comprises at least one selected from a group comprising the following heat and/or acoustic insulating layers: layers of cellulose fibre, layers of mineral wool, layers of wood fibre, layers of wood, layers of plasterboard, layers of Masonite, damp-proofing layers, a layer with steam barrier properties.

The building casing 200 can further comprise empty areas, not filled with insulating material, for defining true and proper ventilation conduits 123, extending internally of the gap 132 and enabling passage of fluid internally of the gap 132. The ventilation conduit 123 extends at least partly parallel to the is extension of the uprights 110, in particular in interposition between the uprights 110 and the closure panels 112 of the external cladding 109.

As previously described, the framework 101 can bear a projecting element 138, which emerges from the external cladding 109; the projecting element 138 extends from a first end located at the upright 110 up to a second end projecting from the external cladding 109: the minimum distance between the second end of the projecting element 138 and the external cladding 109 is equal to or greater than 500 mm, in particular the distance is comprised between 500 and 2500 mm.

Building Structure

Also object of the present invention is a building structure 300 comprising the building casing 200 and the framework 101 as described above; the building structure 300 comprises at least a wall structure comprising at least a base 102 and one or more floor decks 102. The framework 101 is stably engaged to the floor deck and/or base of the structure by means of one or more constraining elements 118; in this condition the building casing too 200 is stably engaged to the wall structure of the building 300: the building casing 200 is able to define an internal environment (I) of the building structure 300 separate from the external environment (E).

The building structure 300 comprises a plurality of constraining elements 118 stably constrained to respective floor decks 102, in particular it comprises pairs of constraining elements 118 mutually flanked and comprising two constraining elements 118 stably anchored on opposite faces of a same floor deck 102 (FIG. 39).

The building structure 300 further comprises a hydraulic plant comprising one or more first pipelines housed internally of the cavity 164 of at least an upright 110 and one or more second pipelines housed internally of the conduit 149: the first pipeline/s and the hydraulic plant extending over at least a section of at least an upright 100 and the second pipeline/s extending over at least a second of the conduit 149. At least one of the first pipelines is in fluid communication with at least one of the second pipelines. In greater detail, the structure 300 comprises an electrical plant comprising at least a first cable housed internally of the cavity 164 of at least an upright 110 and at least a second cable housed internally of the conduit 149; the first cable of the electrical plant extending over at least a section of at least an upright 110 and the second cable extending over at least a section of the conduit 149: the first cable is placed in electrical connection with the second cable.

Process for Realising the Connecting Device

The invention further relates to a process for realising the device 133 described in the foregoing.

The process comprises a first step of predisposing a sheet made of a metal material, extending along a prevalent development plane; the sheet is then cut so as to define a semi-finished piece (blank) comprising at least the first and/or the third connecting portion 139, 141. In fact, the cutting of the sheet already defines the main body 136 on which the portions 139 and 140 are defined. The process can further include a step of forming the main body 136 in which the first portion 139 is distanced from the third portion 141, as can be seen in FIG. 55.

The process can further include a further step of forming the second connecting portion 140 in such a way that it emerges transversally with respect to the third connecting portion 139, 141.

In a first process configuration, the step of forming the second portion 140 comprises at least following sub-steps:

- defining, on the semi-finished piece, by means of a cutting action, a further flat portion parallel to the first and third connecting portions 139, 141;
- bending the further portion in such a way that it emerges perpendicularly with respect to the first and second portion 139, 141.

The forming step of the second portion and the step of offsetting the lie planes of the first and third connecting portions 139, 141 are advantageously performed simultaneously.

In a variant of the process, the forming step of the second connecting portion 140 can include a sub-step of welding the portion 140 on the main body 136 so as to define a projection 137.

Process for Realising the Stirrup

Also object of the present invention is a process for realising the stirrup 119 as described above.

The process comprises a first step of predisposing a sheet of metal material extending along a prevalent development plane; the sheet is then cut so as to define a semi-finished piece (blank). In fact, the cutting of sheet already defines the spacer 156 and/or the base 153 of the stirrup 119.

The process includes various steps of bending the sheet so as to define the constraining portion 151, the spacer and the fixing element 158.

The bending step of the base is carried out in such a way as to define the lips 154 and 155. Following or before the step of forming the lips 154 and 155, the process includes forming the spacer 156 and the fixing element 158. The bending step for defining the spacer and fixing element are advantageously simultaneously performed.

The forming step (bending) of the spacer can further include a sub-step of defining undulations 157 on the body of the spacer.

Process for Realising a Building Structure

A further aim of the present invention is a process for realising a building structure 300 as described above.

The process includes a step of constraining, by means of the first engaging portion 128, the constraining elements 118 to the respective floor deck and/or bases 102. Following this, a series of uprights 110 is positioned, spaced from one another, along a vertical direction, in contact with at least a constraining element 118, in particular in contact with the contact surface 129*a* of the constraining element. Following the positioning of the uprights, the process includes coupling a plurality of uprights 110 to the engaging portion 129 of a single constraining element 118.

The process can include positioning a lower upright 110*a* such that a longitudinal end thereof is arranged at a floor deck 102; following this, the upper upright 110*b* is positioned, about the lower upright 110*a* in such a way that a longitudinal end of the upper upright 110*b* is arranged substantially at the same floor deck 102 at which the lower upright 110*a* is also arranged: the lower upright and the upper upright 110*a*, 110*b* are in this way aligned along a single prevalent development direction. Thereafter the lower upright 110*a* can be constrained, using a first constraining element 118, to a lower surface 102*a* of the floor deck 102 and, with a second constraining element 118, the upper upright 110*b* to an upper surface 102*b* of the floor deck 102.

The step of fixing the lower upright and the upper upright can further comprise a step of axial connecting of the two uprights by means of the positioning of the connecting element 106 internally of the cavity 164 of the two uprights 110*a*, 110*b*. The connecting element is then fixed to the ends of the two uprights in such a way that they are axially connected. The inserting of the connecting element 106 not only enables axial connecting of the two uprights but also enables supporting them.

The process further includes a step of engaging, adjacently to the respective constraining element 118, of one or more closure elements 148; the engaging step comprises coupling the closure element 148 with the constraining element 118 or with the upright 110, in particular with an abutment thereof, to define the conduit 149 at one or more of the constraining elements 118.

Before or after the fixing of the uprights 110 to the floor deck 102, the process includes fixing a connecting device 133 and a projecting element 138 on at least an upright 110.

In particular, the process includes engaging the connecting device 133 to the upright 110, substantially in counterposition to the floor deck 102 and the engaging of the projecting element 138 to the connecting device 133 and to the upright 110 so that the connecting device is interposed between the upright 110 and the projecting element 138.

The engaging step of the connecting device 133 and the projecting element 138 are advantageously carried out simultaneously. In particular, the engaging step of the connecting device 133 and the projecting element 138 comprise following steps:

- positioning the connecting device on the upright 110 such that the first and the second connecting portion 139, 140 of the connecting device 133 contact respectively the core and the second abutment 163, 162 of the upright 110;
- positioning the projecting element 138 on the upright 110 such that the contact surface 144 of the projecting element contacts the core 163 of the upright 110;
- applying blocking means so as to stably fix the connecting device and the projecting element on the upright 110.

The application of the blocking means includes a sub-step of inserting a plurality of screws internally of respective holes of the upright 110, of the connecting device 133 and of the projecting element 138.

The engaging of the projecting element on the frame enables defining a support frame for any balconies or support systems for projecting loads.

Before or after the fixing of the uprights 110 to the floor deck 102, the process includes positioning and subsequently fixing a plurality of stirrups on one or more uprights 110; this step comprises at least following sub-steps:

- coupling the constraining portion of a stirrup 151 and an abutment 161, 162 and/or to a core 163 of an upright 110;
- positioning each stirrup 119 in a predetermined operative position by means of an axial sliding thereof along the upright 110;
- following the movement, applying on the stirrup 119 a projecting load defined by one or more layers of insulating material and/or by the weight of the stirrup 119, the application of the projecting load blocking the square block in the predetermined operative position.

The stirrup 119 is configured so as to be displaced axially along the upright by the action of a predetermined load; this enables the operator to position the stirrup on the upright without fixing it irreversibly: in this way the operator can easily displace and regulate the various heights of the stirrups. Following the correct positioning of the stirrups, the process includes definitive fixing of the stirrups in a predetermined operative position: the fixing is carried out using mechanical systems, for example bolts-nuts and/or rivets.

Only after having fixed and positioned the framework 101 (uprights, connecting device, the projecting element and the stirrups), the process can include a step of predisposing an electrical plant comprising the following steps:

- positioning at least a first cable of an electrical plant internally of the cavity 164 of one or more uprights 110 along at least a section of the longitudinal development of the upright or uprights 110;
- passing a second cable of the electrical plant internally of the at least a conduit 149;

the first cable and the cable being a part of a same electric wiring or being connected electrically to one another.

The process can further include predisposing a hydraulic plant comprising following sub-steps:

- positioning at least a first pipeline internally of the cavity 164 of one or more uprights 110 along at least a section of the longitudinal development of the upright or uprights 110;
- passing a second pipeline of the hydraulic plant internally of at least a conduit 149;

the first pipeline and the second pipeline being a part of a same piping or being connected to one another by a connecting pipe between the two.

After having fixed and positioned the framework 101 (uprights, connecting device, projecting element and stirrups) and the predisposing of the various plants, the process can include further positioning step, in the building casing 200, of one or more layers of heat and/or acoustically insulating material. The step of positioning the layers internally of the building casing 200 comprises at least following sub-steps:

- fixing a plurality of closure panels 111 to the stirrups 119;
- positioning one or more insulating layers 113-117, 121, 122 in the gap;
- fixing a plurality of closure panels 112 to the square blocks so as to define the gap 132 internally of which the layers of insulating material are housed.

Obviously the steps of fixing the plurality of panels 111 and 112 can be inverted.

Further Solution

A further solution is described in the following.

Figure 2:
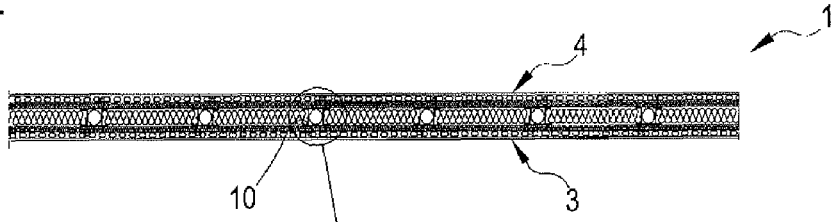
FIG. 2 is a transversal section view of the wall structure shown in FIG. 1.
Figure 3:
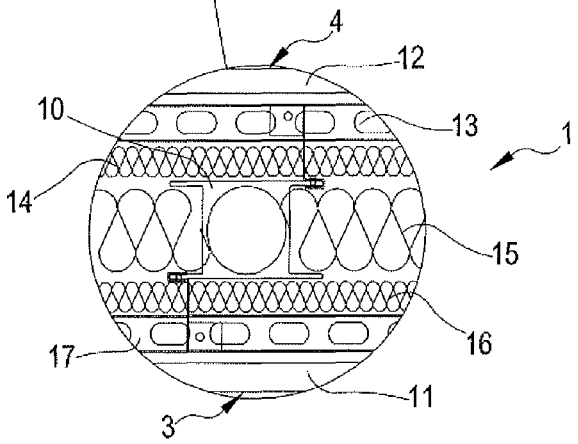
FIG. 3 is a larger-scale view of the section of FIG. 2.

FIG. 1 illustrates, purely schematically, a wall structure 1 according to the present invention, seen from inside the relative building. The structure 1 is anchored to a floor deck 2 of the building and comprises a plurality of vertical uprights 10, arranged parallel at a regular distance, to which the closure panels 11 facing towards the observer are anchored. FIG. 2 is a schematic section of the wall 1. The surface of the wall denoted by reference 3 is facing towards the inside of the environment of the building which the wall delimits. If the wall 1 is a perimeter wall, the surface 4 is the one facing towards the outside, and is thus exposed to atmospheric agents. In this circumstance, between the internal surface 3 and the external surface 4 there is normally a heat gradient. Alternatively, if the wall 1 is a separating wall, the surface 4 is also facing towards a room of the building, for example another room. FIG. 3 is a transversal section view, i.e. horizontal, of a portion of the wall structure 1 containing an upright 10 to which internal and external closure panels 11 and 12 are anchored and comprising a plurality of layers of insulating and/or filler material, 13-17. The uprights 10 are pultruded section bars made of a polymer resin, for example polyester, vinyl ester, epoxy resins, phenolic resins—and reinforcing fibres—for example glass fibre, carbon fibre, Kevlar. The fibres constitute up to 70% in weight of the section bar. The pultruded section bars have mechanical characteristics which can be compared to the corresponding metal section bars made of steel or aluminium, or PVC. This makes the pultruded section bars suitable for use as uprights of wall structures. Irrespective of the excellent mechanical characteristics, the pultruded section bars are also excellent heat and electrical insulators and have good acoustic vibration damping properties. Table 1 that follows summarises the main mechanical characteristics of a pultruded section bar of the above-described type, suitable for use as an upright. It is clear, with respect to a section bar made of steel or aluminium, given an equal section, that the pultruded element is lighter while is still having excellent mechanical characteristics. As will be explained more fully in the following, the section bar used is hollow.

TABLE 1

| Property | Pultruded | Steel | Aluminium | PVC | Unit |
|---|---|---|---|---|---|
| Density | 1.8 | 7.8 | 2.8 | 1.4 | $g/cm^3$ |
| Resistance to traction | 350-400 | 370-500 | 200-400 | 40-60 | MPa |
| stretching under traction | 1.5-2.0 | 13-35 | 5-35 | 10-80 | % |
| Resistance to flexion | 400-450 | 330-500 | 200-400 | 70-100 | MPa |
| Elasticity Modulus | 25-30 | 210 | 70 | 2.8-3.3 | MPa × $10^3$ |
| Flexion strength | 15-20 | 210 | 70 | 2.8-3.3 | MPa × $10^3$ |
| Impact resistance | 200 | 400 | 200 | 85-95 | $MPa/m^2$ |
| Heat conductivity | 0.25-0.35 | 100-230 | 100-230 | 0.15-0.25 | W/m ° C. |
| Coefficient of expansion | 5-20 × $10^6$ | 10-14 × $10^6$ | 20-25 × $10^6$ | 50-100 × $10^6$ | M/m ° C. |
| Dielectric capacity | 5-15 | — | — | 40-50 | KV/mm |
| Volume resistivity | 1010-1014 | 0.2-0.8 | 0.028 | >1016 | ωcm |

Figure 4:
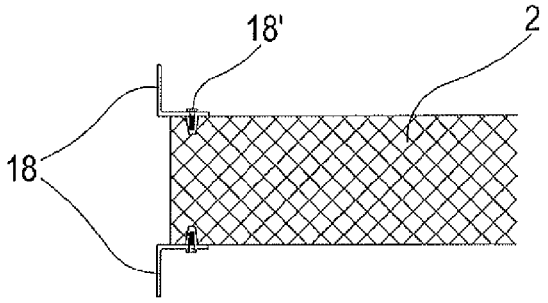
Figure 5:
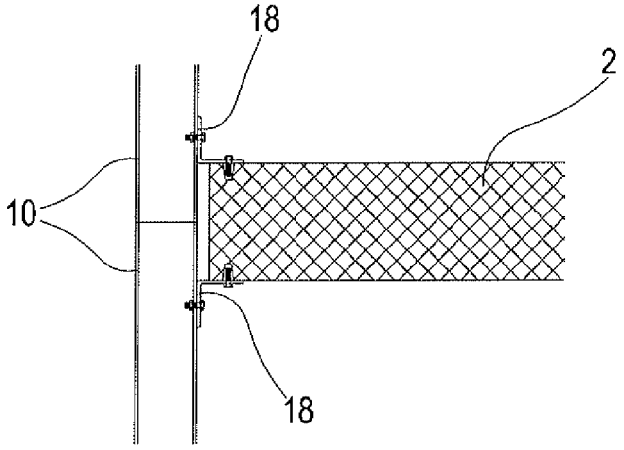
Figure 6:
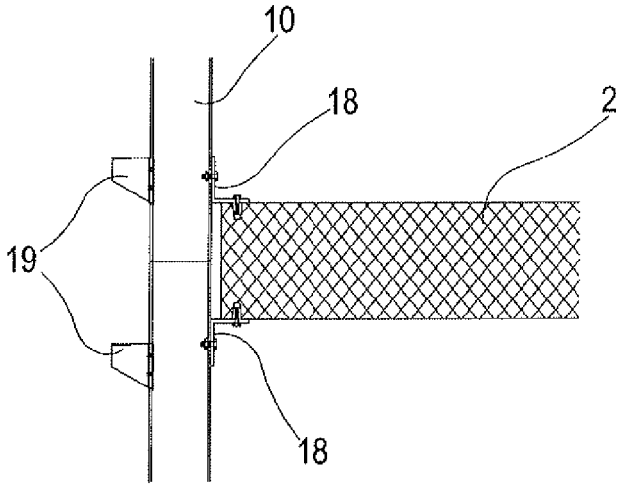
Figure 7:
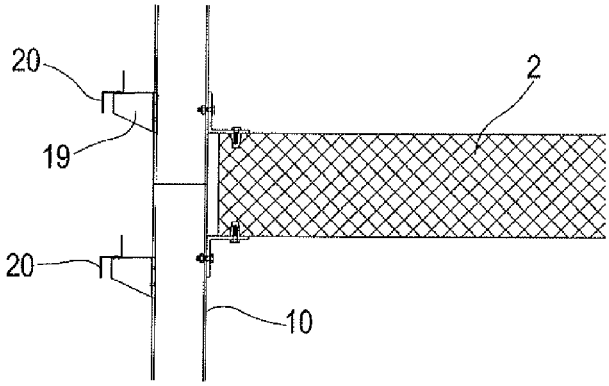
Figure 8:
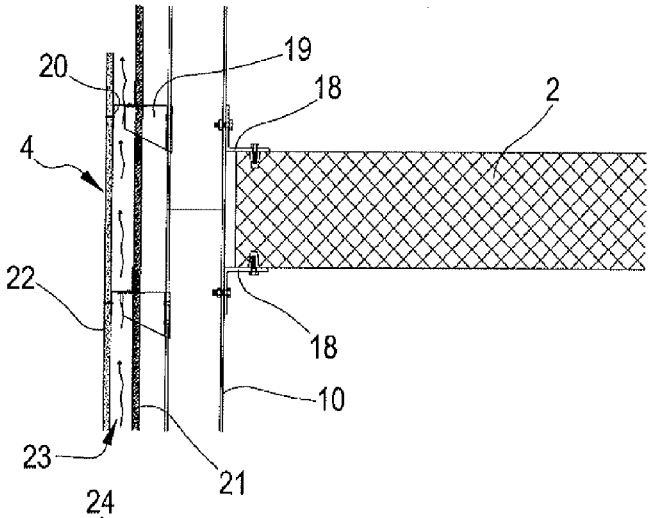

FIGS. from 4 to 11(*c*) show a sequence of operations for installing the wall structure 1. Reference numeral 2 denotes a floor deck of a building, for example a separating deck of a lower plane and an upper plane, for example a separating deck of a lower plane and an upper plane, seen in section considered in a vertical plane that is perpendicular both to the floor deck 2 and the wall structure 1. At first, two metal stirrups 18 are fixed to the floor deck 2, by means of plugs 18' (FIG. 4). A single pultruded upright 10, or two uprights 10 superposed and jointed, are riveted or screwed to the stirrips 18, so as to be solidly constrained to the floor deck (FIG. 5). Metal stirrups 19, preferably stainless steel or galvanized steel, are fixed to the upright 10 at the outside part i.e. on the side facing the opposite side with respect to the floor deck 2 (FIG. 6). Further metal anchors are fixed to the stirrups 19, which serve as a support for closure panels 10 (FIG. 7). Closure panels 12 are fixed to the anchors 20 so as to define the external surface 4 of the wall structure 1. Slabs 21 of an insulating or filler material, for example plasterboard, are constrained to the anchors 20 or the stirrups 19, in an intermediate position between the upright 10 and the external closure panels 12, so as to define therewith a chamber for natural circulation of air 23 (FIG. 8).

Figure 9:
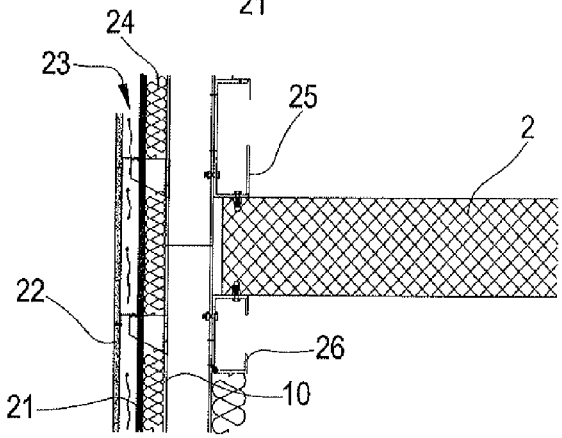
Figure 10:
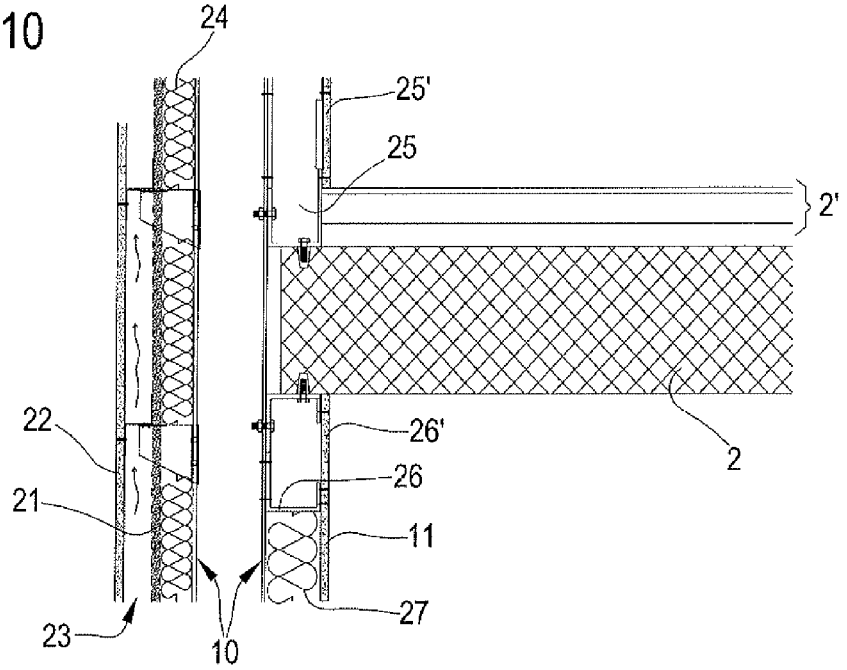

The space between the slabs 21 and the uprights 10 is filled with an insulation material 24, for example mineral wool or cellulose fibre panels. The stirrups 18 are equipped with horizontal channels 25, 26 for housing and guiding plants such as tubes and electric cables 141 (FIG. 9). The channel 25 is connected to the stirrups 18 positioned on the upper plane, at the floor, at the channel 26 is connected to the stirrups 18 positioned at the lower plane, at the floor (FIG. 10). Reference number 2' denotes the layer formed by the screed and tiles. As can be seen, the channel 25 is closed by a removable cover 25' which also has the function of a skirting board. Likewise the channel 26 is closed by a respective removable cover 26'. It is clear that the above-described configuration is particularly advantageous for installation of plant. The uprights 110 together with the channels 25 and 26 form, in the building structure 1, a network of channels in which, for example, the following can be inserted and positioned: tubes, wires, sheaths, or all the components required in an electrical plant, a hydraulic plant and an air-conditioning plant 141 (civil and/or industrial).

The installers are not therefore obliged to break the wall structure 1 in order to insert a corrugated wire guide 141 or discharge tubes 141, but can simply convey these elements into the channels 25, 26 and inside the uprights 10. FIG. 11(*a*) shows a structure 1 anchored to a floor deck 2 provided with a false floor 2" and a floor 2' of the type used for housing tubes 141 of the heating plant.

FIGS. 11(*b*) and 11(*c*) respectively show schematic views in perspective of the wall structure 1, and the relative components, and an enlarged view of a channel 25 in which lines of a domestic plant are housed. FIGS. from 12 to 17 show corresponding possible sections of pultruded uprights 10. In general the uprights can be solid or hollow; preferably however the uprights are hollow so as to minimize the weight thereof, production costs and in order that they can house internally thereof parts of plant. In the examples shown in the figures the sections are provided with tabs 10' which extend starting from the central portion 10". The stirrups 18 and/or 19 are fixed to the tabs 10'.

The internal cavities can be one or more and are denoted by references A-D. Wires and tubes can be housed in the cavities. The pultruded section bars which constituted the uprights 10 advantageously deaden the sounds because of the insulating nature of the materials they are made of. Therefore any noises conveyed by discharge tubes housed in the uprights 10 are not transmitted therefrom to other elements of the wall structure 1, to the advantage of the comfort of the occupiers of the building.

Figure 19:
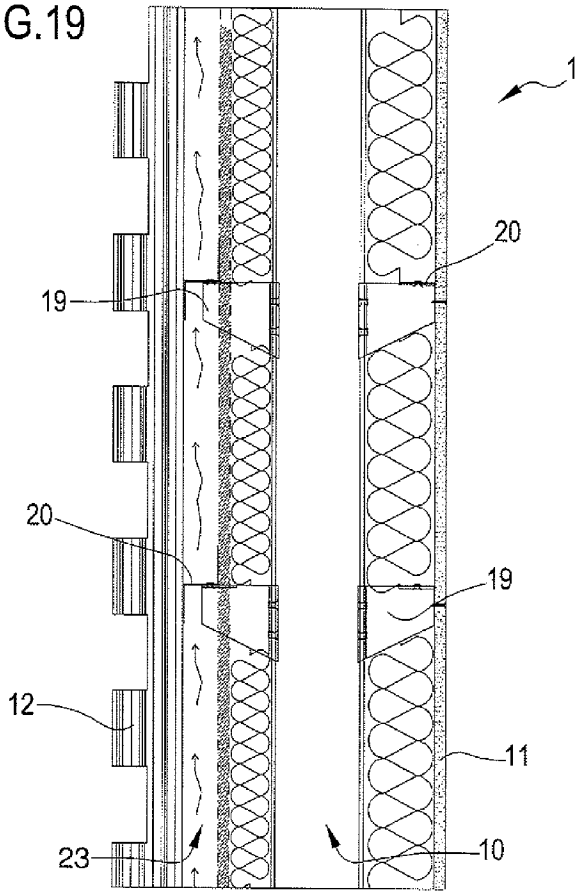
Figure 18:
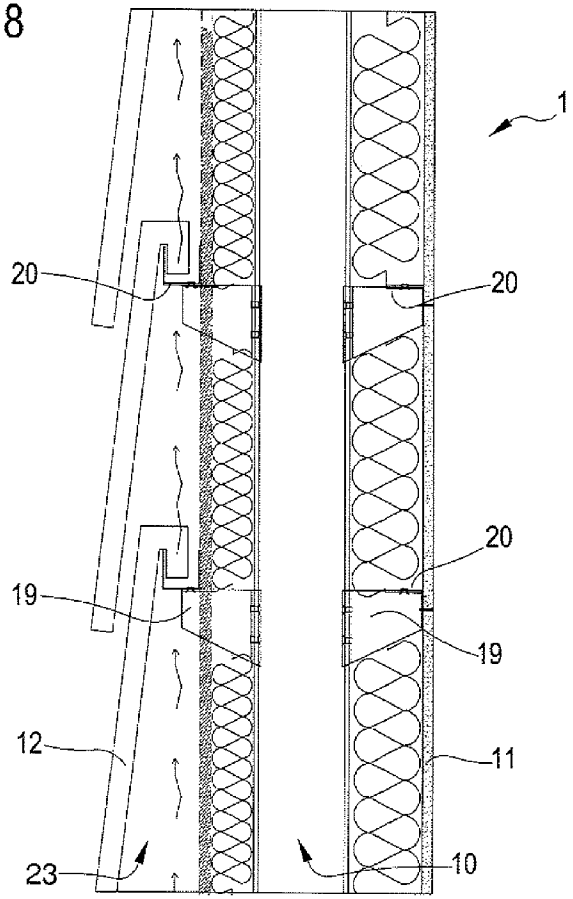

Cavities A-D can be used in various ways, for example cavity A for housing electric wires and cavity B for housing tubes of the conditioning plant. The pultruded uprights are advantageously not sensitive to damp, so any condensed water or leaks from the plants do not compromise the mechanical characteristics of the uprights 10. FIGS. 18 and 19 show, in vertical section, respective examples of installation in which the external paneling 12, anchored to the stirrups 20—in turn supported by the stirrups 19—is constituted by tiles, or blocks of marble.

Figure 21:
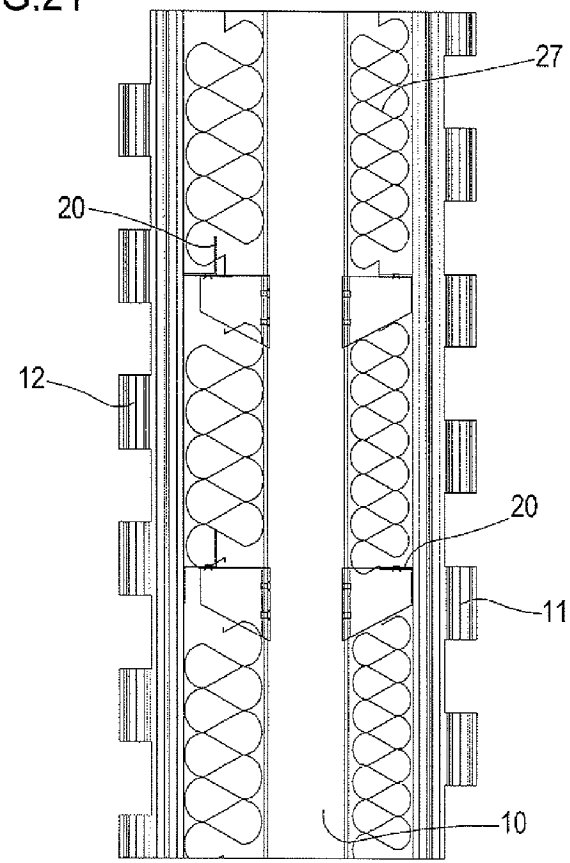
Figure 20:
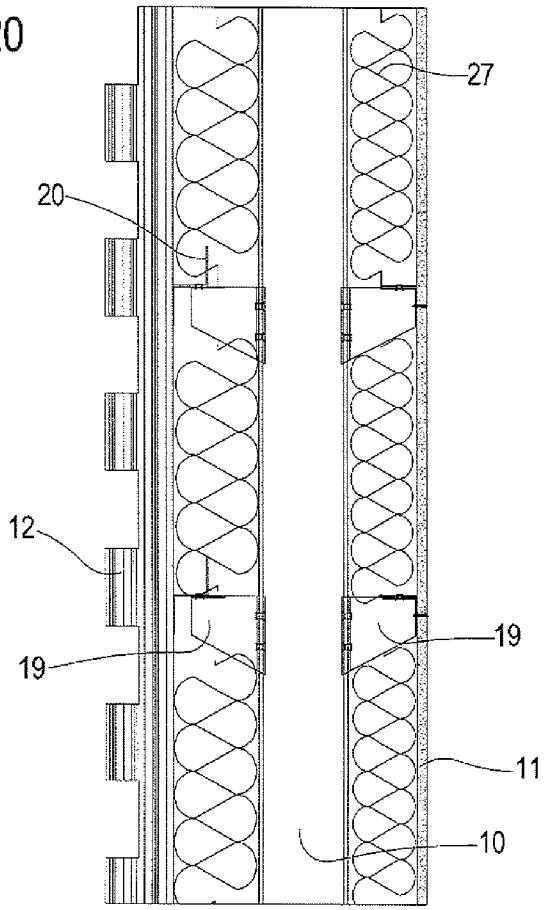
Figure 22:
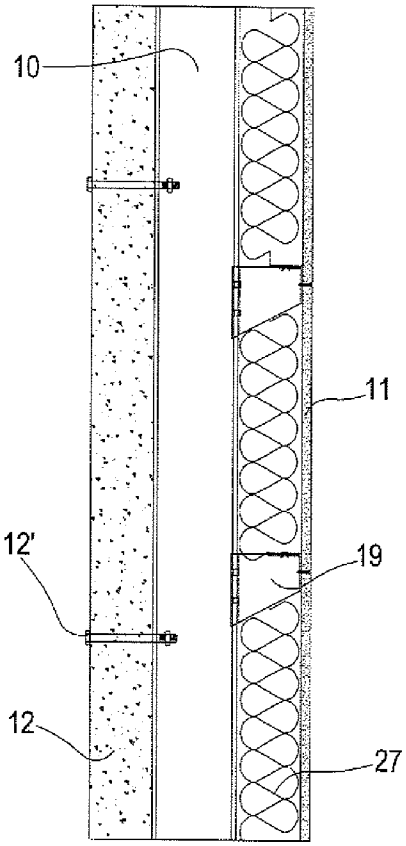

The internal panels 11 are for example made of plasterboard. FIGS. 20 and 21 show, in vertical section, two further examples of installation in which the external paneling 12 is made of granite or another stone material, or of wood. The internal panels 11 are for example made of wood, plasterboard, stone or masonry. There are many possible combinations. FIG. 22 shows an example of installation in which the external paneling 12 is replaced by a concrete slab fixed is to the uprights 10, for example to the tabs 10', with plugs 12'.

Figure 24:
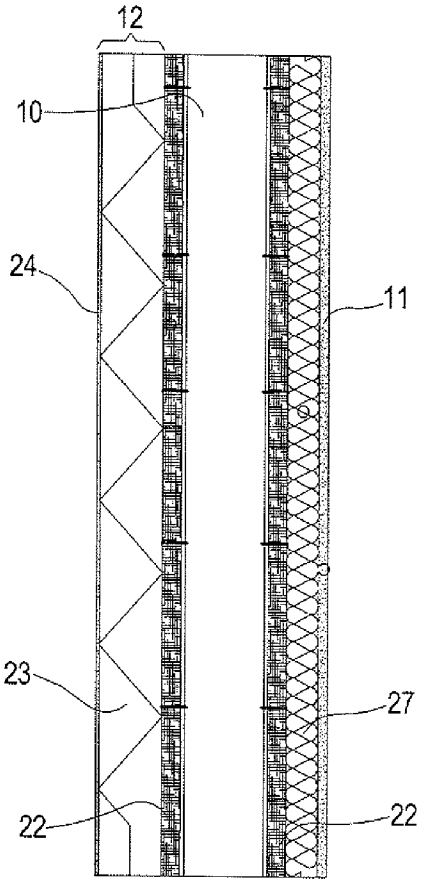
Figure 23:
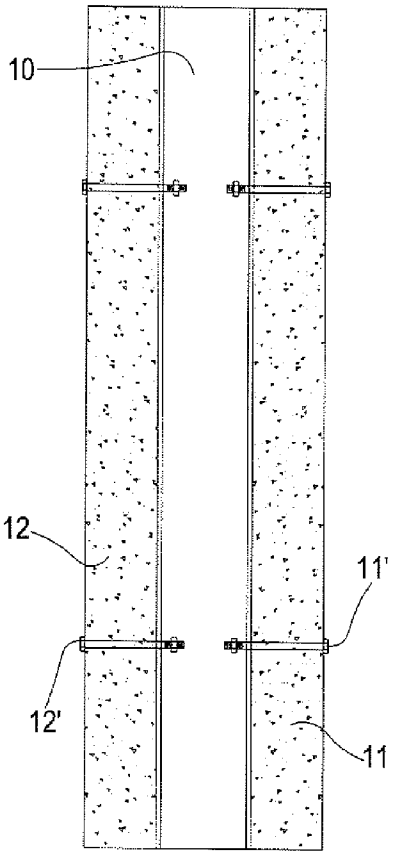

FIG. 23 illustrates an example of installation in which the external paneling 12 and the internal paneling 11 are constituted by concrete slabs. FIG. 24 shows an example of installation in which the external paneling 12 is formed by panels made of foam polystyrene 23 to which a layer of plaster 24 is applied. An insulation 22 is inserted between the panels 12 and the uprights 10. FIG. 25 shows a wall structure 1 according to the present invention which extends to form a ventilated roof C. The structure 1 separates the internal environment I of a building from the external environment E. Externally the structure 1 is struck by solar rays (represented with arrows) which first heat the external closure panels 12, facilitating the natural circulation of air in the ventilation chamber 23. The chamber 23 opens into the atmosphere at a ventilated gable-top.

The channels 25 and 26 are easily accessible for inserting parts of plants. The insulating nature of the uprights 10 and the layering of the insulators give the wall 1 a low heat conductivity. FIG. 26 shows an example of architectural integration of the wall structure 1 with an aeration column shaft, for example of the type used for evacuating vapour aspirated from the fume hood of a kitchen oven. A PVC tube T is inserted in an upright 10 so as to be guided to the roof C and to a breather 30. FIG. 27 shows the distribution of the temperature in a pultruded upright 10 when it is subjected to a temperature gradient, as in practice happens since a part of the structure 1 is exposed to the outside of the building and a part to the inside thereof.

Pitting is greater at lower temperatures, and rarer at higher temperatures; it more often is manifested in the winter months, when externally the temperatures are low and buildings are heated. It can be appreciated how the upright 10 is without thermal bridges, in the sense that at the stirrups 19 there is no transmission of heat and any possible thermal bridge is in reality interrupted. The thermal bridge is broken at the tabs 10', i.e. the stirrups 19 are conductive, being made of metal, but the pultruded section bar constituting the upright 10 is insulated by its own nature. FIGS. 28 and 29 show an applicational example in which the uprights 10 are directly bolted to a base floor 31 of the building and internally of the uprights a tube T is housed, for example a discharge tube of wash-basins. FIG. 28 shows the vertical development of the tube T and FIG. 29 shows the deviation of the tube at the base floor 31.

FIG. 30 is an example of installation in which the wall structure 1 is interrupted by a window frame 32 and comprises also a small balcony 40. The window frame 32 is bolted to the uprights 10 both superiorly and inferiorly. The balcony 40 is also bolted to the uprights 10. In particular, the balcony 40 is also structurable with pultruded elements 10 equivalent to the uprights 10, closed in sandwich fashion for example between external finishings 12 and insulation 24. From the example it is clear how versatile the wall structure 1 of the present invention is, in many ways lending itself to the architectural integration with new or existing structures. FIGS. 31 and 32 relate to an example of installation in which the uprights 10 are used to guide electric wires 41 towards electric sockets or switches 42 positioned in the wall structure 1.

From the above-described examples it can be seen how the structure 1 enables installing or modifying the arrangement of the plants (for example electrical, hydraulic, conditioning, audio) with great simplicity and without any excessively invasive works having to be carried out. The uprights 10 and the channels 25, 26 enable guiding tubes and wires practically everywhere in the building.

FIG. 33(*a*) is a schematic vertical section of a wall structure 1 according to the present invention, at a position of an upright 10. In practice from the point of view of the heat transmittance the structure 1 can be thought of as a sandwich of ten layers, for example the external layer 12 constituted by marble, the internal layer 11 constituted by plasterboard.

In the example shown in the figures, the upright 10 corresponds to three layers: two of which are the tabs 10' and one corresponding to the central portion 10". In particular, the description of the single layers and the relative characteristics in terms of thickness, heat resistance, density and specific heat are provided in the table of FIG. 33(*c*). The tabs 10' of the uprights 10 are considered as layers of polyester resin loaded with glass fibres (one of the possible materials of the pultruded upright); the central portion 10" of the uprights 10, which is hollow, is conceived as an non-ventilated air chamber. The table of FIG. 33B summarises the characteristics of the wall structure 1 in its entirety at the section shown in FIG. 33(*a*). At the section shown (10 layers) the thermal transmittance is 0.1981 W($m^3$*K) and the peak temperature time lag is about 8 hours and 3 minutes.

FIG. 33(*d*) is a graph showing the progression of the maximum external temperature (summer) over a 24-hour period and the corresponding hourly progression of the surface external temperature at the layer 12 and the surface internal temperature at the layer 11. An analysis of the graph shows that at the peak the temperature of the external layer 12 is equal to or slightly below 55° C.; is this occurs towards midday when solar radiation is strong. At the same time the internal surface temperature of the layer 11 of the wall structure 1 is still low, at around 30° C., i.e. about 25° C. less than the temperature of the external surface 12. The structure 1 is advantageously characterised by a low thermal transmittance, so the temperature peak reaches the internal surface a little after 8 pm, i.e. eight hours later, in the evening. FIG. 34(*a*) is a schematic vertical section of a wall structure 1, according to the present invention, at an intermediate portion between two uprights 10. In this circumstance there are nine structural layers.

In particular, the description of the single layers and the maximum characteristics in terms of thickness, heat resistance, density and specific heat are supplied in the table of FIG. 34(*c*). The table of FIG. 34(*b*) summarises the characteristics of the wall structure 1 in its entirety at the second shown in FIG. 34(*a*). At the section shown (9 layers) it can be seen that the total thermal transmittance is 0.19 W($m^3$*K) and the time lag at peak temperature is about twelve hours and twenty-two minutes. FIG. 33(*d*) is a graph showing the progression of the maximum summer temperature in a twenty-four hour period and the corresponding hourly progressions of the external surface temperature at layer 12 at the layer 12 and the internal surface temperature at the layer 11.

The analysis of the graphic shows that at the relative peak the temperature of the external layer 12 is equal to a little below 55° C., towards midday. At the same time the internal surface temperature of the wall structure 1 is equal to about 34° C. The temperature peak reaches the internal surface towards midnight, i.e. twelve hours later. The comparison between FIGS. 33(*d*) and 34(*d*) reveals how the presence of the uprights 10 influences only minimally the thermal is transmittance of the structure 1, which shows the success of the structure in terms of thermal insulation.

Advantages of the Present Invention

The uprights 10, 110 are advantageously pultruded section bars made of a polymer resin and reinforcing fibres. This characteristic is of great relevance, as the uprights 10 made in this way, with a combination of material used and the realization method, exhibit excellent physical and mechanical characteristics and can be used also as bearing elements (as well as being used to support the internal and external panels). Further, the use of uprights 10, 110 made of a polymer resin and reinforcing fibres (thermo-insulating materials) makes the wall structure 1 and the building structure 300 free of thermal bridges between the external side and the internal side. The external panels and the internal panels are anchored to the uprights which by their nature are thermally insulating. With respect to a traditional wall structure, for example provided with uprights made of reinforced concrete or steel, the structure of the present invention is characterised by the low thermal transmittance coefficient that can be obtained with it. Even in the presence of high thermal gradients between the outside of the building and the inside, the wall structure and the building structure offer excellent performance in terms of low heat conductivity.

A further advantage provided by the choice of pultruded uprights made of a reinforced polymer resin is constituted by the excellent acoustic insulation characteristics thereof. Differently to many traditional technical solutions, in the structure of the present invention the uprights deaden sound instead of transmitting it.

By virtue of the foregoing, the wall structure of the invention enables obtaining, with a certain facility, the performances required by building structures according to national and international standards, in terms of heat insulation and acoustic insulation. Not least, a further advantage relates to the modest economic cost. Manufacturing pultruded section bars requires less energy with respect to the consumption associated to production processes of aluminium or steel section bars. The polymer resin used for manufacturing the uprights is preferably a thermosetting resin, for example polyester, epoxy resin, acrylic resin, vinyl ester, phenolic resin. Alternatively the resin is thermoplastic, for example PVC, polyurethane, polyethylene. The resin is preferably loaded with reinforcing fibres selected from: glass fibre, carbon fibre, or synthetic fibres such as Kevlar and Mylar. The fibres can be constituted by single filaments, by a bundle of filaments, or by single threads (spun yarn), or can be bundles of assemble threads (roving). The reinforcing fibres preferably constitute about 70% in weight of the section bar: resistance to static and dynamic loads provided by pultruded uprights loaded with reinforcing fibres is high. By way of example, consider table 1, reproduced herein above, which shows typical values of mechanical resistance. In general the wall structure described above enables supporting loads of up to 200 kg hung from the walls; for example this is the case of shelves loaded with books, kitchen cupboards, large sanitary appliances hung from walls.

In the preferred embodiment, the uprights have a constant transversal section and comprise at least an internal cavity. This cavity, which runs along the whole extension of the upright, acts as an air chamber, or an aeration conduit, or as a housing for components of electrical and/or hydraulic and/or technological plants, for example pipes, electric cables, fans.

This characteristic makes the wall structure of the present invention effective for integration and maintenance of plant. By choosing hollow pultruded section bars, they are configured as vertical conduits in which the elements of the plants can run, for example through several floors of the building or even to different heights on a same floor, without its being necessary to intervene invasively on the wall structure in its entirety, either during the installation or at any time after the end of construction work on the building.

The availability of numerous housing conduits of elements of plants present in each upright provided in the wall structure makes the structure itself extremely versatile in meeting the needs of the occupants of the building so as to made changes to the plants at any moment. The uprights can in fact be pierced to insert cables, pipes. For example, it frequently happens that after years of residence an apartment block resident decides to modify the arrangement of the furniture and therefore also the distribution and number of electric sockets and switches.

The possibility of using the internal cavities of the uprights makes the structure versatile, as it provides the possibility of easily modifying the electrical plant without demolishing the walls and creating only minimum discomfort to neighbours. The same needs emerge when for example a unit is subdivided into other and smaller units.

A further advantage is that the pultruded uprights have, in comparison with materials such as steel or aluminium, a low module of flexion and a low specific weight. Therefore, in a case of seismic activity, the dynamic behavior of the wall structure is such that the uprights are subject to a lower inertia and to flexions of a smaller entity with respect to what would occur, given same conditions and sections, with steel or aluminium uprights.

The uprights preferably have a constant and substantially double T-shaped transversal section. In an embodiment of the wall structure according to the present invention, the shape and dimensions of the section of the uprights are chosen so as to make the wall structure a bearing structure. In other words the wall structure can be configured to support not only its own weight or the weight of external objects fixed thereto, for example shelves or cupboards, but also the weight of overlying structures, for example covers, balconies, beams: in this circumstance the uprights will a larger section.

In an embodiment, the internal and external panels are constrained to the respective uprights by means of first brackets or stirrups. The stirrups, for example made of galvanized steel, or steel treated with anti-corrosive substances, are anchored to the uprights with a snap-fit system and thereafter are stably fixed using screws, bolts or rivets. The structure of the stirrups is particularly advantageous as it enables them, in the anchoring condition, to block with respect to the upright on the action of its own weight or a greater weight and at the same time to be easily moved axially with respect to the upright. The possibility of moving the stirrup significantly facilitates the steps of installing the structure, in particular the step of aligning the stirrups. Following the correct positioning of the stirrups they can be stably fixed using screws, bolts or rivets.

The stirrups are shaped so as to extend projectingly from the relative upright, so as to support an internal or external panel at a certain distance from the upright. By using the desired extension of the stirrups it is possible, during the realization of the wall, to regulate the thickness of the gap according to needs. In turn the panels can be fixed variously to the stirrups, for example with screws, bolts or rivets, and/or by jointing or with glue. The uprights are joined to the base of the building and/or are fixed to the floor decks of the building by means of the constraining element 118 or stirrups 18. In practice, the uprights are transported to the worksite and laid vertically one by one; the installing includes the anchoring of the uprights to a floor and, preferably, the fixing to the floor decks of each plane of the building by means of stirrups anchored to the floor decks, for example using plugs or screws or bolts.

The gap defined between the internal and external panels of the wall structure is preferably filled, entirely or partly, with one of more materials 27 that are heat and/or acoustically insulating and/or with parts of plants such as, for example, mixers, tube manifolds, WC flush tanks. For example, the gap can be filled in part with slabs of foam polystyrene, cork, mineral wool, wood, sound-absorbing foam sheets. A portion can be left empty to enable natural circulation of air in the gap. The sheets of insulation material are preferably also anchored to the first stirrups.

In the preferred embodiment of the present invention the wall structure comprises a plurality of metal channel and housing channels, for example for cables and/or pipes of plant and/or ventilation conduit.

The channels and the conduits have substantially a C-shape and each channel is predisposed horizontally and is fixed either to the relative uprights, being crooked with respect thereto, or to a floor deck of the building, to the floor or floor part. With this configuration each channel also acts as a fixing element of the uprights to the floor decks. This embodiment is particularly advantageous for example for the predisposing of electric cables, tubes in the rooms of the building. The channels positioned in place of the traditional skirting board or at the edge of the floor can be closed with an aesthetically-appealing covering element easily removable so as to allow the inserting of cables/tubes in the channels, which then can be re-closed. A technical expert in the sector will understand that in this way it is not necessary to break the wall as is proposed in the traditional solutions when a plant is added to a room, for example an air-conditioning plant supply pipes. The installers simply have to gain access to the channels.

The technical expert in the sector will clearly understand that the wall structure of the present invention, in the various embodiments thereof, is usable to realize perimeter walls and internal separating walls of civil and industrial buildings, as long as they are not bearing walls.

The structure of the present invention is also usable for realizing projecting elements such as, for example, balconies, or for realizing inclined roofs or ventilated roof gable-tops.

In general the wall structure of the present invention, in its various embodiments, can be realised in prefabricated modules that are jointable to one another on the work-site, during installation. For example, the modules can be sent from the factory to the work-site already layered with the internal panels, the external panels and the insulating layers.

Some models can be provided by the factory already with the discharge tubes or aeration tubes inserted in the uprights, in order to simplify as far as possible the installation thereof.

The invention claimed is:

1. A support framework for building casings comprising:

uprights each of which is at least partly made of a heat-insulating material and extends along a first prevalent development direction between a first and a second longitudinal end, each upright being configured to extend vertically between a first floor deck or base and a second floor deck or base of a building structure;

a constraining element including a first engaging portion configured to be stably constrained to a floor deck or base of a building structure, the constraining element further including a second engaging portion stably anchored to at least one of said uprights;

wherein the constraining element extends along a second prevalent development direction transversal to the first prevalent development direction of the uprights, the second engaging portion of the constraining element mechanically connecting with a plurality of said uprights wherein the first engaging portion of the constraining element comprises a rest surface configured to abut against an upper surface or lower surface of the floor deck or base, the second engaging portion of the constraining element comprising a respective rest surface configured to abut against a fixing portion of the upright, the first and second rest surfaces being arranged perpendicularly, with respect to one another, wherein the first and the second engaging portions of the constraining element define a section bar having a substantially L-shape transversal section, said section bar extending transversally to the uprights and being directly engaged to a plurality of said uprights, and wherein the first and the second engaging portions of the constraining element are joined to form a single body, wherein each upright comprises at least two uprights aligned substantially along a single prevalent development direction so as to define a lower upright and an upper upright consecutive to one another, facing ends of said lower and upper uprights being configured so as to be arranged at a same floor deck of a building structure, wherein the constraining element comprises:

at least a first constraining element stably engaged to the lower upright and configured to stably constrain to a lower surface of a floor deck, at least a second constraining element stably engaged to the upper upright and configured to stably constrain to an upper surface of the same floor deck, wherein the lower and upper upright are axially abutted, facing ends of the lower and upper upright being at least partially in contact with one another, the framework comprising at least a connecting element which axially constrains the lower upright with the upper upright, wherein the connecting element comprises a first engaging portion constrained to the fixing portion of the lower upright, the connecting element further comprising a second engaging portion constrained to the fixing portion of the upper upright, wherein the first engaging portion of the connecting element is stably connected to the first constraining element, the fixing portion of the lower upright being interposed between the first engaging portion of the connecting element and the first constraining element, and wherein the second engaging portion of the connecting element is stably connected to the second constraining element, the fixing portion of the upper upright being interposed between the second engaging portion of the connecting element and the second constraining element.

2. The framework of claim 1, wherein each upright comprises, in transversal section, at least a first and a second opposite abutments interconnected by at least a connecting core transversal to said abutments, the first abutment defining the fixing portion coupled to the second engaging portion of the constraining element, wherein the first abutment, the second abutment and the core define, in transversal section, at least one C-profile having a cavity arranged laterally with respect to the constraining element, wherein the first abutment comprises a plate having an elongate conformation exhibiting a thickness smaller than a length and a width of the same plate, the first abutment exhibiting a flat surface abutted against the second rest surface of the constraining element, and wherein the second abutment comprises a plate exhibiting a thickness that is smaller with respect to the length and width of the same plate, the second abutment exhibiting a respective flat surface opposite flat surface abutted against the surface of the first abutment with respect to the upright.

3. The framework of claim 2, wherein the core comprises at least an elongate plate exhibiting a thickness that is less than the length and width of the same plate, wherein the plates defining the first and the second abutments extend on planes that are parallel to one another, wherein the plate defining the core extends along a perpendicular plane to the plates of the first and second abutment, wherein the upright comprises a length, measured along the first prevalent development direction thereof, of greater than 2000 mm, wherein the upright exhibits a thickness, measured transversally to the first prevalent development direction of the upright and parallel to the core, defined by the maximum distance between the first and the second abutment, said thickness being greater than 100 mm, wherein the upright exhibits a width, measured transversally to the first prevalent development direction of the upright and transversally to the core, said width being defined substantially by a width of the first and/or the second abutment and being greater than 50 mm.

4. The framework of claim 1 comprising a series of uprights flanked to one another and substantially parallel to one another, the constraining element connecting all the uprights of said series to one another, wherein for each 10 linear meters measured along the second prevalent development direction of the constraining element the series has at least 2 uprights, and wherein the uprights exhibit a minimum distance from one another greater than 0.4 m.

5. The framework of claim 1, wherein the first engaging portion of the constraining element comprises a first plate exhibiting a thickness that is less than a length, measured along the second prevalent development direction of the constraining element, and a width, measured perpendicularly to the second prevalent development direction of the constraining element, wherein the ratio between the length of the first plate of the first engaging portion and the width of the same plate is greater than 7, wherein the ratio between the length of the first plate of the first engaging portion and the thickness of the same plate is greater than 400, wherein the ratio between the width and the thickness of the first plate of the first engaging portion is greater than 20, wherein the width of the first plate is greater than 75 mm, wherein the minimum thickness of the first plate is greater than 1.5 mm, wherein the second engaging portion of the constraining element comprises a second plate exhibiting a thickness of less than the length and width of the same plate, wherein the ratio between the length, measured along the prevalent development direction of the constraining element and the width of the second plate is greater than 7, wherein the ratio between the length, measured along the prevalent development direction of the constraining element, and the thickness of the second plate is greater than 400, wherein the ratio between the width and the thickness of the second plate is greater than 20, wherein the second plate exhibits a width, measured perpendicularly to the second prevalent development direction of the constraining element, of greater than 100 mm, wherein the second plate exhibits a thickness, measured perpendicularly to the second prevalent development direction of the constraining element, of greater than 1.5 mm.

6. The framework of claim 1, wherein the constraining element comprises a section bar having a transversal section that is constant along the development of the constraining element, wherein the second prevalent development direction of the constraining element is substantially straight, wherein the first prevalent development direction of the uprights is substantially straight, each upright exhibiting a constant transversal section along the development thereof.

7. The framework of claim 1, wherein the uprights comprise a polymer resin and reinforcing fibers drowned in said resin, wherein the polymer resin comprises at least a comprises at least one selected from a group of the following materials: polyester, epoxy resin, acrylic resin, vinyl ester, phenolic ester, PVC, polyurethane, polyethylene, wherein the reinforcing fibers comprise at least one selected from a group of following materials: glass fibers, carbon fibers, synthetic fibers, basalt fibers, wherein the uprights are section bars obtained by means of a pultrusion process using the polymer resin, to form a section bar having a body of an insulating plastic matrix in which are drowned continuous reinforcing fibers arranged parallel to the first prevalent development direction along a whole length of the upright.

8. The framework of claim 1, wherein the connecting element comprises a plate that is at least partly complementarily shaped to the cavity defined along the upright, and wherein the connecting element is housed inside the cavity and exhibits, in a transversal section, surfaces in contact with the core and the abutments of the same upright.

9. The framework of claim 2, wherein said at least a constraining element comprises a closure portion emerging from the second engaging portion on a same side on which the first engaging portion is arranged so as to define a section bar having a substantially C-shaped section with a concavity facing in an opposite direction with respect to the upright, the concavity of said section bar defining a conduit configured so as to accommodate in passage tubes, cables and/or to define a fluid passage, wherein the closure portion extends over an entirety of the length of the constraining element, and wherein at least a connecting passage is comprised between said conduit of a constraining element and said cavity defined longitudinally along the upright or uprights.

10. A support framework for building casings comprising:

uprights each of which is at least partly made of a heat-insulating material and extends along a first prevalent development direction between a first and a second longitudinal end, each upright being configured to extend vertically between a first floor deck or base and a second floor deck or base of a building structure;

a constraining element including a first engaging portion configured to be stably constrained to a floor deck or base of a building structure, the constraining element further including a second engaging portion stably anchored to at least one of said uprights;

wherein the constraining element extends along a second prevalent development direction transversal to the first prevalent development direction of the uprights, the second engaging portion of the constraining element mechanically connecting with a plurality of said uprights;

wherein the first engaging portion of the constraining element comprises a rest surface configured to abut against an upper surface or lower surface of the floor deck or base, the second engaging portion of the constraining element comprising a respective rest surface configured to abut against a fixing portion of the upright, the first and second rest surfaces being arranged perpendicularly, with respect to one another, wherein the first and the second engaging portions of the constraining element define a section bar having a substantially L-shape transversal section, said section bar extending transversally to the uprights and being directly engaged to a plurality thereof, and wherein the first and the second engaging portions of the constraining element are joined to form a single body, wherein each upright comprises, in transversal section, at least a first and a second opposite abutments interconnected by at least a connecting core transversal to said abutments, the first abutment defining the fixing portion coupled to the second engaging portion of the constraining element, wherein the first abutment, the second abutment and the core define, in transversal section, at least one C-profile having a cavity arranged laterally with respect to the constraining element, wherein the first abutment comprises a plate having an elongate conformation exhibiting a thickness smaller than a length and a width of the same plate, the first abutment exhibiting a flat surface abutted against the second rest surface of the constraining element, and wherein the second abutment comprises a plate exhibiting a thickness that is smaller with respect to the length and width of the same plate, the second abutment exhibiting a respective flat surface, and wherein said constraining element comprises a closure portion emerging from the second engaging portion on a same side on which the first engaging portion is arranged so as to define a section bar having a substantially C-shaped section with a concavity facing in an opposite direction with respect to the upright, the concavity of said section bar defining a conduit, wherein the closure portion extends over all the length of the constraining element, and wherein at least a connecting passage is comprised between said conduit of the constraining element and said cavity defined longitudinally along the upright or uprights.

* * * * *